US005739803A

United States Patent [19]

Neugebauer

[11] Patent Number: 5,739,803

[45] Date of Patent: Apr. 14, 1998

[54] ELECTRONIC SYSTEM FOR DRIVING LIQUID CRYSTAL DISPLAYS

[75] Inventor: Charles F. Neugebauer, San Jose, Calif.

[73] Assignee: Arithmos, Inc., Santa Clara, Calif.

[21] Appl. No.: 186,372

[22] Filed: Jan. 24, 1994

[51] Int. Cl.[6] ..... G09G 3/36

[52] U.S. Cl. ..... 345/98; 345/89; 345/100

[58] Field of Search ..... 345/95, 98, 89, 345/87, 100, 94, 147, 148, 149, 208, 209, 210; 359/54, 55; 349/33, 34

[56] References Cited

U.S. PATENT DOCUMENTS

| | | | |
|---|---|---|---|
| 3,668,639 | 6/1972 | Harmuth . | |
| 3,955,187 | 5/1976 | Bigelow . | |
| 4,060,801 | 11/1977 | Stein et al. . | |
| 4,127,848 | 11/1978 | Shanks . | |
| 4,156,923 | 5/1979 | Lampe et al. . | |
| 4,203,104 | 5/1980 | Kmetz . | |
| 4,317,115 | 2/1982 | Kawakami et al. . | |
| 4,380,008 | 4/1983 | Kawakami et al. . | |
| 4,496,219 | 1/1985 | Altman . | |
| 4,506,955 | 3/1985 | Kmetz . | |
| 4,510,444 | 4/1985 | Haussel et al. . | |
| 4,630,122 | 12/1986 | Morokawa et al. . | |
| 4,766,430 | 8/1988 | Gillette et al. . | |
| 4,800,382 | 1/1989 | Okada et al. . | |
| 4,824,211 | 4/1989 | Murata . | |
| 4,857,906 | 8/1989 | Conner . | |
| 5,155,447 | 10/1992 | Huijsing et al. . | |
| 5,258,934 | 11/1993 | Agranat et al. . | |
| 5,420,604 | 5/1995 | Scheffer et al. . | |
| 5,434,588 | 7/1995 | Parker | 345/98 |
| 5,440,322 | 8/1995 | Prince et al. | 345/58 |
| 5,459,482 | 10/1995 | Orlen | 345/98 |
| 5,459,495 | 10/1995 | Scheffer et al. | 345/147 |
| 5,475,397 | 12/1995 | Saidi | 345/95 |
| 5,548,302 | 8/1996 | Kuwata et al. | 345/89 |

FOREIGN PATENT DOCUMENTS

| | | | |
|---|---|---|---|
| 522510A2 | 7/1992 | European Pat. Off. . | |
| 507061A2 | 10/1992 | European Pat. Off. | G09G 3/36 |
| 585466A1 | 3/1993 | European Pat. Off. . | |
| 598913A1 | 5/1993 | European Pat. Off. . | |
| 595495A2 | 10/1993 | European Pat. Off. . | |
| 604226A2 | 12/1993 | European Pat. Off. . | |
| 617397A1 | 3/1994 | European Pat. Off. . | |
| 621578A2 | 4/1994 | European Pat. Off. . | |
| 622772A1 | 4/1994 | European Pat. Off. . | |
| 678844A1 | 4/1995 | European Pat. Off. . | |
| 5422856 | of 0000 | Japan . | |
| 2062929 | 10/1980 | United Kingdom . | |
| 2280058 | 7/1994 | United Kingdom . | |
| WO 9423414 | 10/1994 | WIPO . | |
| WO 9425955 | 11/1994 | WIPO . | |
| WO 9429842 | 12/1994 | WIPO . | |
| WO 9500945 | 1/1995 | WIPO . | |
| WO 9501628 | 1/1995 | WIPO . | |
| WO 9504986 | 2/1995 | WIPO . | |
| WO 9513603 | 5/1995 | WIPO . | |
| WO 9527972 | 10/1995 | WIPO . | |

OTHER PUBLICATIONS

Francis J. Kub et al., "Programmable Analog Vector–Matrix Multipliers," *IEEE* 1990, vol. 25, No. 1, p. 207–214.

(List continued on next page.)

*Primary Examiner*—Xiao Wu
*Attorney, Agent, or Firm*—Lyon & Lyon LLP

[57] ABSTRACT

A novel electronic apparatus for driving passive x-y addressed liquid crystal displays (LCDs) and having improved display performance is disclosed and claimed. This apparatus is comprised of row driving integrated circuits capable of driving row lines of the LCD with a pattern of voltages corresponding to the basis vectors of a linear transform matrix. Column driver circuits containing analog CMOS pixel memory store video information and compute the linear transform of the pixel matrix. High voltage amplifier circuits to drive the column lines with voltages corresponding to the linear transform of the pixel matrix columns can be monolithically integrated with the transform computation circuitry. The LCD screen inherently performs the inverse transform and displays the desired pixel matrix. The speed and contrast of the LCD are improved, allowing the display of video rate images on passive LCD screens.

19 Claims, 15 Drawing Sheets

OTHER PUBLICATIONS

Roger Melen, "Charge–Coupled Devices: Technology and Applications," *IEEE Press,* New York, New York 1977, pp. 327–328.

N.V. Madhusudana et al., "A Convenient Multiplexing Scheme for Addressing Small Liquid Crystal Matrix," in *Proceedings of an International Conference 1979,* Bangalore, India, pp. 499–503.

T.N. Ruckmongathan, "Some New Addressing Techniques for RMS Responding Matrix LCDs," Indian Institute of Science (Thesis), Bangalore–560012 (Feb. 1988).

T.N. Ruckmongathan et al., "New Addressing Techniques for Multiplexed Liquid Crystal Displays," *Proc. of the SID* 1983, vol. 24, No. 3, pp. 259–262.

Y. Kaneko et al., "Full–Color STN Video LCDs," *Proc. of the SID* 1991, vol. 32, No. 4, pp. 345–350.

T.N. Ruckmongathan, "A Generalized Addressing Technique for RMS Responding Matrix LCDs," *1988 International Display Research Conference,* pp. 80–85.

A.A. Vasilev et al., "Controlled Phase Transparencies in Coherent–Optical Systems Performing Walsh and Hilbert Transformations," *Sov.J. Quantum Electron.* 7(9), 1977, pp. 1089–1093.

"Continuous Addressing Makes LCD Bright and Flicker–Free," *Electronics,* vol. 52:7.

Henning F. Harmuth, "A Generalized Concept of Frequency and Some Applications," *IEEE Transactions on Information Theory* 1968, vol. 14, No. 3, pp. 375–382.

Henning F. Harmuth, "Survey of Research and Development in the Field of Walsh Functions and Sequency Theory," *Applications of Walsh Functions 1973 Proceedings,* pp. 1A–9.

T.J. Scheffer and B. Clifton, 'Active Addressing Method for High–Contrast Video–Rate STN Displays,' in Proceedings of the Society for Information Display Conference, Boston, pp. 228–231, 1992.

B. Clifton, D. Prince, B. Leybold, T.J. Scheffer, A.R. Conner and B. Greenberg, 'Optimum Row Functions and Algorithms for Active Addressing,' in Proceedings of the Society for Information Display Conference, Seattle, pp. 89–92, 1993.

S. Ihara, Y. Sugimoto, Y. Nakagawara, T. Kuwata, H. Koh, H. Hasebe and T.N. Ruckmongathan, 'A Color STN–LCD with Improved Contrast, Uniformity and Response Times,' in Proceedings of the Society for Information Display Conference, Boston, pp. 232–235, 1992.

T.N. Ruckmongathan, T. Kuwata, T. Ohnishi, S. Ihara, H. Koh and Y. Nakagawa, 'A New Addressing Technique for Fast Responding STN LCDs,' in Proceedings of the 12th International Display Research Conference, pp. 65–68, 1992.

A.R. Conner and T.J. Scheffer, 'Pulse–Height Modulation (PHM) Gray Shading Methods for Passive Matrix LCDs,' in Proceedings of the 12th International Display Research Conference, pp. 69–72, 1992.

T.N. Ruckmongathan, 'Addressing Techniques for RMS Responding LCDs — A Review,' in Proceedings of the 12th International Display Research Conference, pp. 77–80, 1992.

B. Clifton and D. Prince, 'Hardware Architectures for Video– Rate, Active Addressed STN Displays,'0 in Proceedings of the 12th International Display Research Conference, pp. 503–506, 1992.

H. Mano, S. Nishitani, K. Kondo, J. Taguchi and H. Kawakami, 'An Eight–Gray–Level Drive Method for Fast–Responding STN–LCDs,' in Proceedings of the Society for Information Display Conference, Seattle, pp. 93–96, 1993.

G.J. Sprokel, 'The Physics and Chemistry of Liquid Crystal Devices,' Plenum Press, New York and London, pp. 105–133, 1980.

J. Nehring and A.R. Kmetz, 'Ultimate Limits for Matrix Addressing of RMS–Responding Liquid–Crystal Displays,' IEEE Transactions on Electron Devices, vol. ED–26, No. 5, pp. 795–802, 1979.

P.M. Alt and P. Pleshko, 'Scanning Limitations of Liquid–Crystal Displays,' IEEE Transactions on Electron Devices, vol. ED–21, No. 2, pp. 146–155, 1974.

S. Nishitani, H. Mano, Y. Kudou, T. Futami and T. Inuzuka, 'New Drive Method to Eliminate Crosstalk in STN–LCDs,' in Proceedings of the Society for Information Display Conference, Seattle, pp. 97–100, 1993.

ELECTRONIC SYSTEM FOR DRIVING LIQUID CRYSTAL DISPLAYS

TECHNICAL FIELD

The present invention relates to methods and apparatus for driving x-y addressed liquid crystal displays.

BACKGROUND OF THE INVENTION

Liquid crystal displays (LCDs) have seen widespread use in portable computers and portable televisions in which features such as low power and small size are absolute necessities. Cathode ray tubes (CRTs), however, remain the dominant display technology for wall-plug applications, such as computer monitors and televisions, due to low manufacturing cost and high picture quality. The established high volume television market has spurred many improvements in the CRT which can now be manufactured cheaply in large screen sizes. Currently, the typical low cost CRT can display motion video at much higher contrast and speed as compared to typical LCD displays. Only prohibitively expensive active matrix LCD screens can match the picture quality of the typical CRT, relegating LCD technology to those applications in which weight and power are overriding concerns as compared to cost, screen size and picture quality. Therefore, one object of the present invention is to provide a low cost technology that improves the performance and reduces the power requirements of inexpensive LCD panels, thereby providing cost competitive alternatives to traditional CRT products.

Fundamental tradeoffs exist in LCD display performance between contrast, response time and resolution. Currently, conventional solutions use LCD materials that have response times long enough to attain sufficient contrast for computer screens. Faster responding LCD materials are commonly available, but are not used because of fundamental limitations inherent to the conventional electrical driving methods presently used to produce images on the liquid crystal display. Computer applications, such as word processing, generally do not require fast response or high contrast and thus are less demanding of display technology than, for example, moving video images. Video rate response times, however, are not presently attainable by standard passive LCDs. Liquid crystal materials that have response times fast enough to display video images can not be used in a conventional passive LCD, as unacceptably poor contrast and limited grayscale control would result. Before the performance tradeoffs are further explained, a description of a simple x-y addressed passive liquid crystal display is provided.

A typical passive x-y addressed liquid crystal display is manufactured by patterning horizontal (also known as x or row) and vertical (also known as y or column) transparent electrodes on the inner surface of two glass panels. These electrodes are used to control the brightness of an array of dots (pixels) that form the image on the display. The glass panels are separated by a few microns, forming a cavity that is then filled with liquid crystal material. Sealant around the edge of the glass panels keeps the material in place. Small glass spacing beads or rods are also dispersed in the liquid crystal material to keep the cavity dimension constant.

At each location where a row and column electrode cross, a pixel is formed. Typical computer and television displays have more than 100,000 pixels. By electrically controlling a given row and a given column electrode, a pixel at the intersection of the row and column electrodes can be made light or dark. By scanning information quickly onto the row and column electrodes, a video image is formed. By judiciously choosing the liquid crystal material and cavity geometry, the response time of the display can be controlled.

Incoming video signals are typically serial streams of data that sequentially encode successive rows of pixels. The most commonly used method for addressing LCDs has been to pulse one row electrode at a time to a single high voltage and to simultaneously drive the column electrodes with differing voltages that correspond to the video or pixel information for that particular row. A given row of pixels is pulsed or activated in proportion to the desired optical output for that row. This operation is repeated for all rows, i.e. the rows are sequentially cycled through to activate the whole panel. This addressing method is referred to in the art as 'row-at-a-time' addressing and with minor variations is the predominant LCD addressing method. The LCD panel is continually refreshed, typically sixty times a second or more, to sustain the desired pattern of light/dark pixels across the display.

For high resolution displays, each pixel receives excitation for only a small fraction of the frame refresh period. Each pixel gets one large excitation pulse per frame when its row is activated and then the optical output of the pixel decays with a response time characteristic of the LCD material. This addressing method limits the response time and contrast of LCDs due to a phenomena known in the art as 'frame response.'

Liquid crystal displays have an intrinsic frame response time that represents the amount of time required for the liquid crystal material to return to equilibrium state after an electric field is placed across the liquid crystal material. The response time can be expressed as $nd^2/K$, wherein n is the average viscosity of the liquid crystal material, d is the cavity length and K is the average elastic constant of the liquid crystal material. For a conventional passive LCD, having a cavity length of 8–10 micrometers, the response time is approximately 300 milliseconds. Thus, the response time of a LCD pixel can be adjusted by changing the chemical composition of the liquid crystal material and/or the LCD cavity length.

In order to sustain the pixel information throughout each frame refresh period, the response time of the LCD material is typically designed to be much longer than the frame refresh period. When the refresh period of the driving waveforms is much less than the intrinsic material response time, which is the case for conventional passive LCDs, the liquid crystal material then effectively responds to the average square electric field placed across it, i.e. the material response is a function of the root-mean-square (RMS) voltage that is applied across the material.

For LCD materials capable of video rate response, however, this response time approximation is not valid, since the LCD material response time is approximately the same as the frame refresh period. Therefore, the effective voltage seen by the pixel decays within each frame refresh period for fast materials. This decay causes the light output to drop within the frame refresh period which, in turn, results in significantly reduced video contrast. This well known speed versus contrast tradeoff, known in the art as the 'frame response' problem, limits the speed of high resolution passive LCDs to response times that are generally greater than 150 milliseconds, even when contrast is designed to be limited. These factors have prevented passive LCD technology from being utilized in applications in which video rate response (less than 50 milliseconds) and high contrast (greater than 20:1) pictures are required.

Two design techniques have been described to overcome the performance limitations of passive LCDs. One technique, known in the art as active matrix, improves performance of the LCD by fabricating a thin-film transistor (TFT) switch at each pixel location. In conjunction with the parasitic and linear capacitances of the pixel, the transistor acts to hold a near constant voltage across the liquid crystal material during the entire frame refresh period. This technique requires the fabrication of a transistor array on the glass panel with one transistor for each pixel.

By using transistor switches to decouple the addressing operation from the voltage-to-light operation, active matrix displays exhibit improved contrast, grayscale and speed. However, the manufacturing cost associated with fabricating approximately one million TFTs (for example, a 640 by 480 color display) without defects on a screen size substrate is very high. A single faulty interconnect or transistor results in a visually noticeable missing pixel, rendering the screen unusable. Scaling active matrix manufacturing technology to large screen sizes significantly increases these manufacturability problems.

In addition, the area taken up by the transistor and wiring at each pixel is not transparent and reduces the amount of light transmitted through the LCD. For the same brightness as the conventional passive LCD described above, an active matrix LCD requires a more powerful backlight, thereby increasing system power consumption versus a passive LCD. Thus, complicated manufacturing steps, esoteric materials and low yields contribute to making active matrix technology expensive and difficult to scale to larger screen sizes.

A second set of techniques, known as enhanced addressing, has also been described for driving passive LCD panels. See e.g., Nehring and Kmetz; 'Ultimate limits for matrix addressing of RMS responding liquid crystal displays,' *IEEE Trans. on Electron Devices*, ED-26(5), pp. 795–802, 1979. In their investigations on the limitations of addressing RMS materials, Nehring and Kmetz developed a mathematical framework for describing the action of several different LCD addressing methods. Essentially, Nehring and Kmetz describe the row and column line voltages as two time dependent vectors wherein the resultant LCD material response time is proportional to the time-averaged square of the difference of the two vectors at each pixel. The LCD panel effectively integrates the excitation over the entire frame refresh period with a time constant characteristic of the particular liquid crystal material. Row-at-a-time addressing, as well as other addressing methods, are easily described using this framework.

One of the methods that Nehring and Kmetz described employed Walsh basis functions as the row vectors. A Walsh transform is a linear transform having binary basis vectors. Nehring and Kmetz described driving the row lines sequentially with Walsh basis vectors and driving the column lines with the Walsh transform of the desired pixel values. The LCD material, by virtue of its RMS response, effectively performs the inverse transform and causes the screen to display the desired pixel pattern. Nehring and Kmetz also noted that any linear transform can be used, including the identity transform, which is simply row-at-a-time addressing. A number of algorithmic enhancements and implementations based upon the Nehring and Kmetz article have been proposed. European Patent Application No. 92102353.7 (EPO Publication Number 0507061A2); A. R. Conner and T. J. Scheffer, 'Pulse-Height Modulation (PHM) Gray Shading Methods for Passive Matrix LCDs,' in *Proceedings of the 12th International Display Research Conference*, pp. 69–72, 1992; T. N. Ruckmongathan, 'Addressing Techniques for RMS Responding LCDs—A Review,' in *Proceedings of the 12th International Display Research Conference*, pp. 77–80, 1992; S. Ihara, Y. Sugimoto, Y. Nakagawa, H. Hasebe and T. N. Ruckmongathan, 'A Color STN-LCD with Improved Contrast, Uniformity and Response Times,' in *Proceedings of the Society for Information Display Conference*, Boston, 1992, pp. 232–235. The work in these articles is herein collectively referred to as 'enhanced addressing schemes.'

The key aspect of the enhanced addressing methods originally described by Nehring and Kmetz is that multiple selection pulses are applied to each pixel during each frame refresh period. By distributing the pixel pulses throughout the frame period, the LCD optical output is not permitted to decay as much as would be the case with row-at-a-time addressing. Accordingly, LCD materials with faster response times may be used in passive LCDs to achieve video rate response without loss of contrast.

Furthermore, if the number of rows in the display that are selected to be pulsed is large and the particular transform is chosen properly, the probability is low that a basis vector and a pixel column vector are highly correlated. The beneficial statistical implication of this low probability is that the transform results will be tightly distributed about a median value. Given that the transform results will rarely exceed certain voltage bounds, the pixel excitations throughout the frame period are similarly bounded. Thus, the pixels receive excitation distributed throughout the frame refresh period instead of one large pulse. Coupled with the temporal response of the LCD material, the result is a much smoother light output waveform than is possible with row-at-a-time addressing. Additionally, the voltage ranges of the column drivers can be limited since it is highly improbable that a transform result will exceed the statistically bounded limits. Thus, lower voltage circuitry can be used to implement this addressing method which, in turn, reduces cost and power consumption.

One important practical problem not confronted by Nehring and Kmetz concerns the fact that the LCD material responds to the RMS voltage and not to the inner-product of the row/column voltages, as is required for an inverse transform. The exact expression for the LCD response provided in both the Nehring and Kmetz article and in P. M. Alt and P. Pleshko, 'Scanning Limitations of Liquid Crystal Displays,' *IEEE Transactions on Electron Devices*, Vol. ED-21, pg. 146, 1974 is:

$$V_{RMS}^2 = \frac{1}{N}\sum_{t=0}^{N-1}[V_{Row}(t) - V_{Column}(t)]^2 = \frac{1}{N}\sum_{t=0}^{N-1}[V_{Row}(t)^2 - 2V_{Row}(t)V_{Column}(t) + V_{Column}(t)^2]$$

This expression for the RMS voltage across a pixel contains three terms, the first of which is the constant RMS contribution of the basis vectors. A voltage that is representative of those basis vectors is driven onto the row electrodes of the LCD. The second term is the 'cross term' which is the desired inner-product of the row/column vectors and performs the necessary inverse transform. The third term is common to all pixels in a column and is proportional to the sum of the squares of the pixel values in that column. In the Nehring and Kmetz article, in which Nehring and Kmetz considered only the possibility of binary pixels, the third term of the equation above is a constant. But in practice, the third term varies for grayscale (i.e. non-binary) pixel values and represents an error in the desired information pattern on the display. Therefore, another object of the present invention is to calculate a compensation term that corrects the aforementioned error.

A transform based addressing method requires that the linear transform of the pixel data be performed for each frame. For typical screen resolutions and video frame rates, often a billion or more mathematical operations per second must be performed, even using the most efficient 'fast' transform algorithms. If a digital processor is used to implement this transform, power, display cost, size and part count are significantly increased above a typical passive LCD. In the digital transform addressing implementations discussed in EP0507061A2, a LCD driving system is described that requires one or more digital processor integrated circuits (ICs) capable of computing arbitrary binary transforms of pixel data, in addition to digital frame buffers.

The need for digital frame buffer memories in digital implementations of the addressing methods described by Nehring and Kmetz adds significantly to part count, power consumption and cost. The frame buffer memories are inherently necessary to a digital display since the goal of the addressing scheme is to distribute the data for each pixel throughout the frame. Thus, the information for all pixels must be available for the entire frame period. The bandwidth and power consumption of digital frame buffer memories alone act as a significant deterrent to the digital implementation of algorithmically addressed passive LCDs for portable products.

Another implementation discussed in EP0507061A2 is a LCD driving system wherein the digital frame buffer memory and computation circuits are integrated onto the column driver ICs. This approach has the advantage of eliminating the memory bandwidth problem by integrating the memory and computing means onto the same IC. Implementing this system consists of employing of a method for computing the dot products of binary basis vectors and binary pixel matrix column vectors using logical exclusive—or (XOR) gates and either digital or analog summation circuits. The binary implementations discussed in EP0507061A2 are impractical to integrate on the column driver IC due to the limited density of memory array and compute circuits, the need for on-chip high voltage circuitry and the high power dissipation of the digital circuits. Furthermore, grayscale operation requires a significantly larger memory array and even more power-hungry computation resources.

Grayscale operation is typically achieved in most passive LCD addressing schemes either by frame rate control or by subdividing each scan address period (i.e. 1/480th of the frame period for a 480 line display) into a number of smaller periods, during which multiple voltage pulses are driven onto the column electrode lines to achieve the desired gray shade. These grayscale techniques require that the column and possibly the row drivers transition multiple times within each effective scan address period.

However, due to the row and column electrode resistance and the capacitance of the liquid crystal material, the fast transition row and column signals required for enhanced addressing grayscale operation are significantly distorted across the display. The waveform distortions create display artifacts that are unacceptable for many applications. Moreover, since the row and column electrodes are transitioning multiple times during each scan address period, the row and column electrode driver circuits require significantly more power than a single transition solution. As the number of gray scales increases above roughly 8 levels, the aforementioned problems become significant. Thus, another object of the present invention is to provide an alternative addressing solution that can display pixel images with a high number of gray scales (i.e. greater than 32) using a single transition per scan address period while at the same time reducing power consumption, simplifying driver IC design and easing the resistance requirement for the row and column electrodes.

The incurred cost and power penalties that are inherent to current LCD driving methods are unacceptable for the portable video display and computer markets and limit the ability of LCDs to break into established CRT markets, where cost and picture quality are the dominant features.

SUMMARY OF THE INVENTION

The present invention relates to electronic systems for implementing transform addressing. The present systems makes possible the integration of an implementation of transform addressing onto a small number of ICs. Conventional LCD panels can be driven by a number of row and column driver ICs that are connected to the row and column electrodes of the LCD. The present invention replaces the column driver ICs in a conventional LCD panel with a set of transform column driver ICs that are capable of combining memory, computation and high voltage driver circuitry.

By performing the transform computation within the column driver IC, the number of ICs needed for a transform addressing system is about the same as a conventional passive LCD panel. Thus, the present system has the advantage over a functionally equivalent digital implementations of transform addressing, such as the digital implementation described in EP0507061A2, because such a digital system requires a number of additional ICs to perform the computation and addressing function, i.e. at least two high bandwidth frame buffer memories are required in addition to the transform computation ICs. The large part count of the digital system results in increased system size, power consumption and cost, while at the same time reducing system reliability. The present invention reduces these problems by minimizing the number of necessary ICs, as well as, reducing the power consumption of the LCD driver ICs.

The transform computation is performed in the present invention by an array of analog pixel memory cells that are capable of computing a transform of the pixel data in parallel. Preferably, a binary or a ternary transform is computed. The present invention implements a 'discrete' transform as opposed to the more computationally efficient 'fast' transform. A discrete transform provides the advantage that the transform results are available serially, thereby obviating the need for a parallel-to-serial conversion frame buffer, as is required by 'fast' digital implementations.

The present invention also permits the calculation of RMS error correction terms that compensate for the RMS errors associated with driving LCDs. Grayscale operation can be obtained with the present invention without using multiple transition schemes for column waveforms. This grayscale operation scheme is advantageous because multiple transition schemes require higher temporal resolution row and column waveforms and have higher power dissipation.

The present invention provides a low power, high performance method of computing the RMS correction terms to provide grayscale output with single transition operation, thereby reducing power consumption, simplifying driver IC design and easing the resistance requirement for the row and column electrodes. By reducing the resistance requirement of the mostly transparent row and column electrodes, thinner electrodes that transmit more light and therefore reduce backlight power consumption can be used. Furthermore, high resistance, clear electrodes are easier to fabricate than low resistance electrodes, especially when integrated color filters are desired. Thus, use of high resistance, clear electrodes can reduce manufacturing costs.

The LCD addressing system described herein calculates a DC term of the transform that is typically larger than the other higher order transform terms and will likely exceed the voltage bounds of the system. To avoid a 'frame response'-like problem, the present invention provides a method and an apparatus for attenuating and distributing the DC information within the frame period. Similarly, the RMS correction terms are also temporally distributed within the frame period to avoid a 'frame response'-like problem.

The present invention also provides addressing methods that can be sequenced to provide row and column signals that will not introduce a net DC voltage across the LCD pixel matrix. A sustained net DC voltage across an LCD can damage the liquid crystal material and lead to LCD failure. Enhanced addressing schemes typically rely upon the low probability that the basis and pixel column vectors are highly correlated to avoid net DC biasing of the pixel matrix, but these schemes are not guaranteed to prevent irreversible long-term device failure from net DC biasing.

The present invention permits the use of analog IC technology which, in turn, provides the advantages of extremely low power consumption and small size as compared to functionality equivalent digital circuits, such as those described in EP0507061A2. Therefore, the present analog system can be used in battery powered systems in which functionally equivalent digital implementations are not practical.

The present invention provides the contrast and speed enhancements of transform addressing with negligible cost or power penalties, thereby opening new markets for portable video devices. Large screen video products, currently dominated by CRT technology, are made possible with transform addressed passive LCD panels, since scaling passive LCD technology is easier than scaling active matrix LCD technology. Also, portable computers and televisions implementing the present invention will run longer on batteries due to reduced power consumption, while at the same time displaying video images rivaling the quality of CRTs.

The addressing methods of the present invention can drive inexpensive passive matrix LCD panels to produce video images that are comparable in quality to images produced by more expensive active matrix LCD displays and bulkier CRTs. By avoiding the expensive fabrication steps associated with active matrix LCD fabrication, manufacturing costs are also reduced. Furthermore, due to the relatively simple manufacturing process for passive LCDs, as compared to the process for manufacturing active matrix LCDs, the cost of the requisite LCD manufacturing facilities is also reduced.

The transform column driver IC of the present invention implements a high voltage amplifier to drive the column lines and permits the use of commonly available IC fabrication processes that typically support only low voltages. The present invention uses parasitic devices present in standard IC fabrication processes to make reliable high voltage circuitry. Currently, conventional LCD driver ICs are fabricated using specialized high voltage CMOS fabrication processes that are more expensive per chip to fabricate than the commodity digital CMOS processes capable of being utilized by the present invention. By using a commodity CMOS process which affords much higher circuit density, the transform column driver ICs of the present invention are about the same size as conventional column driver ICs, even though the ICs of the present invention contain significantly more circuitry and computational capabilities.

Another advantage of the present invention is that the transform addressed passive LCD panels described herein can be manufactured for approximately the same cost as conventional passive LCDs with the additional benefits of fast video rate response and improved contrast. Conventional passive LCD production facilities can be easily modified to produce transform addressed displays using the technology disclosed herein.

The present invention also has the advantageous feature of permitting the acceptance of direct analog input video in interlaced or non-interlaced formats. A functionally equivalent digital implementation requires a digital frame buffer memory that in turn increases cost, part count and power consumption of the LCD addressing system. By obviating the need for a frame buffer, the present invention permits the loading of direct broadcast interlaced video input directly into the transform column driver ICs, thus making low cost consumer television implementations possible.

The computation circuitry of the present invention provides a low power, compact realization of a binary transform system that can be used in a variety of applications other than transform addressed LCD systems, such as pattern recognition systems, neural network systems and video compression systems. The present invention provides an implementation of a linear transform, a basic building block of many signal processing systems used in a variety of applications.

Although not necessary to practice the present invention, the high voltage amplifiers described herein provide an inexpensive implementation of high voltage output driver circuits that can be monolithically integrated on the same substrate as the low voltage CMOS computation circuitry. The high voltage circuitry also can be used separately from the transform computation circuitry in applications where high voltage circuits are needed, such as telecommunication ICs, EPROM/EEPROM memory devices and power control circuits. Active matrix LCDs also require high voltage drivers for the row and column lines. Components of the high voltage amplifier described herein can be used to implement DC-to-DC converter circuitry, voltage regulation and high-low driver circuits in which the output voltages can exceed the typical voltage limitations of the semiconductor fabrication technology.

Other advantages and aspects of the present invention will become apparent upon review of the detailed description of the preferred embodiment, the figures and the claims.

PREFERRED EMBODIMENT

Figure 1:
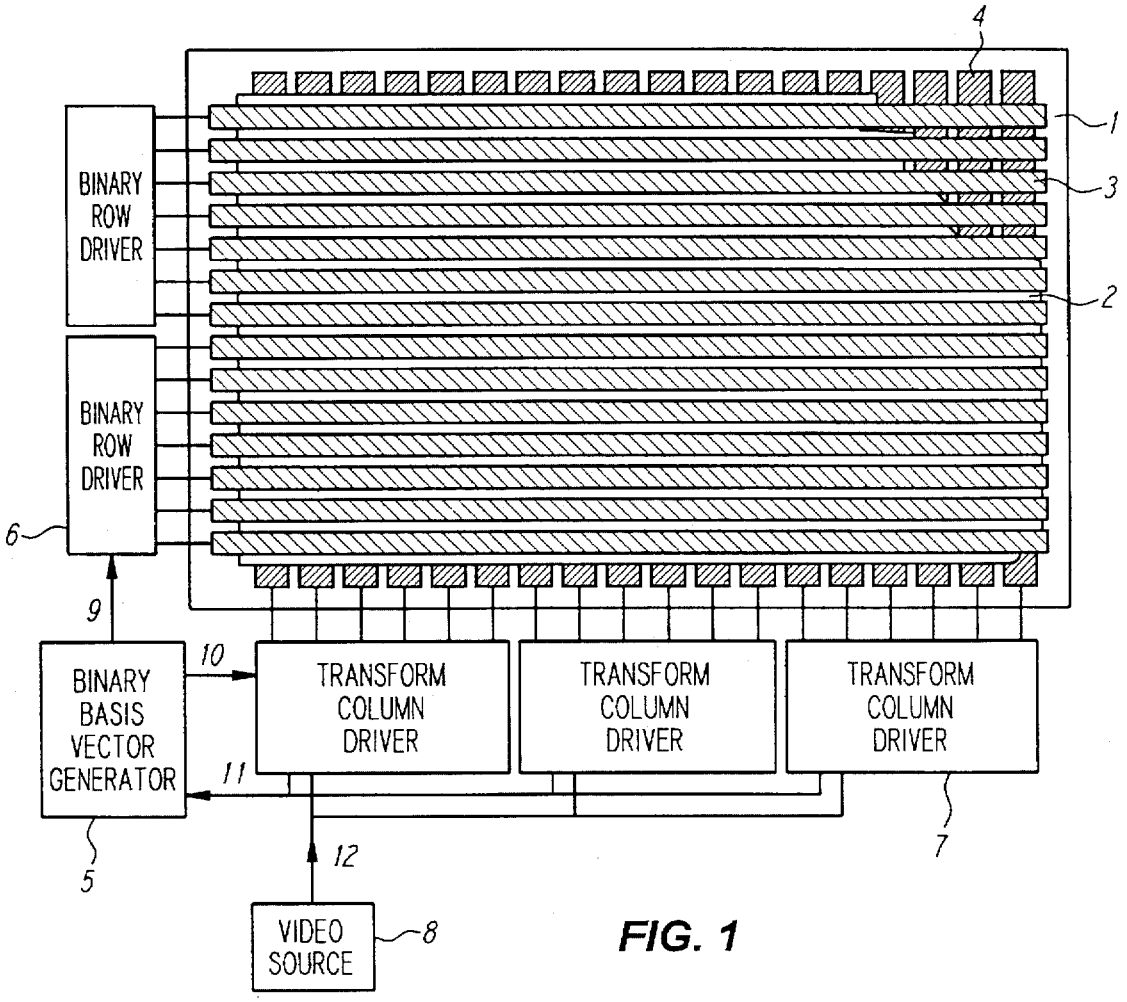
FIG. 1 is a block diagram representation of a LCD driving system that includes a LCD panel, a set of binary row driver ICs, a set of transform addressing column driver ICs, a video source and an IC that generates binary transforms.

The preferred embodiment of the present invention is a system that provides electrical stimulus to a passive LCD display. A block diagram of the system is shown in FIG. 1. The conventional LCD panel consists of a glass substrate (1) and a liquid crystal formulation with dispersed spacers (2) sandwiched between transparent horizontal (3) and vertical (4) electrodes. The upper glass plate to which the horizontal electrodes of FIG. 1 are attached is not shown for clarity. As defined herein, horizontal, x or row electrodes are intended to embody the same structure. Similarly, vertical, y or column electrodes are also meant to define the same structure. These electrodes are commonly manufactured to be perpendicular to each other, although for the purposes herein no preferred geometry of electrodes is assumed other than the fact that row electrodes intersect column electrodes to form pixels.

The row drivers (6) utilized in the preferred embodiment can be conventional high/low LCD line drivers, such as Texas Instruments part number TMS57210A, that can drive 160 LCD row/column electrodes with an arbitrary high/low pattern. The column driver ICs (7) that implement the present invention perform the computations necessary for transform addressing.

I. Transform Addressing

The transform addressing system described herein can be used for those LCD applications in which the liquid crystal material responds to the square of the voltage difference applied across the liquid crystal material. For a display with time varying voltages on the row and column electrodes, $V_R(t)$ and $V_C(t)$ respectively, the LCD material responds to the average square voltage. This voltage can be expressed as the summation:

$$V_{RMS}^2 = \frac{1}{N}\sum_{t=0}^{N-1}[V_R(t) - V_C(t)]^2, \tag{1}$$

wherein N is the number of discrete samples contained in the frame refresh waveforms, $V_R(t)$ and $V_C(t)$. By expanding the terms of the summation, the activation seen by the pixel can be separated into three terms:

$$V_{RMS}^2 = \frac{1}{N}\left[\sum_{t=0}^{N-1} V_R^2(t) + \sum_{t=0}^{N-1} V_C^2(t) - 2\sum_{t=0}^{N-1} V_R(t)V_C(t)\right]. \tag{2}$$

The optical output of typical LCDs is a nonlinear function of the RMS voltage expressed above. Equation (2) describes the basic LCD response under the assumption that the liquid crystal material has a response time much longer than the refresh period of the driving waveforms. For materials with shorter response times, additional factors can influence the display output.

Transform addressing is performed by driving the row electrodes with voltages proportional to the basis vectors of a linear transform and synchronously driving the column electrodes with the linear transform of the desired pixel matrix. The pertinent details of transform addressing can be shown by considering a single column of pixels with the desired numerical values described by the vector P(i).

In the following example, the row signals for transform addressing are column vectors of a binary transform matrix W(i,t) that operates on the pixel column vector, P(i), to form a set of transform signals, T(t). A binary transform is chosen since it only requires high/low row drivers and simplifies transform computation. Those skilled in the art will recognize that other linear transforms, including the Fourier Transform, the Hartley Transform and the Chirp-Z Transform, can be used to practice the present invention. Examples of appropriate alternative transforms can be found in A. V. Oppenheim and A. S. Willsky, Signals and Systems, Prentice-Hall, Englewood Cliffs, 1983.

The binary transform matrix of this example is restricted to having values of plus or minus one only. The transform obeys conventional linear transform relationships as described in K. G. Beauchamp, *Walsh Functions and Their Applications*, Academic Press, London, 1975. The transform, inverse transform and Parseval's relationships between pixel data and transformed data are defined, respectively, as:

$$T(t) = \frac{1}{N}\sum_{i=0}^{N-1} W(i,t)P(i) \tag{3}$$

-continued $$P(i)=\sum_{t=0}^{N-1} W(i,t)T(t)$$

$$N\sum_{t=0}^{N-1} T^2(t)=\sum_{i=0}^{N-1} P^2(i).$$

Row electrodes of the present invention are driven sequentially with voltages, $V_R(i,t)$, that are proportional to the N binary transform column vectors from t=0.N−1. At the same time, each column electrode for a given column of pixels P(i) is driven with a voltage, $V_C(t)$, that is proportional to the transform of the pixel data, T(t), where $V_r$ and $V_c$ are proportionality constants:

$$V_R(i,t)=V_rW(i,t)V_C(t)=V_cT(t). \tag{4}$$

Thus, combining equations (2) and (4), the average square activation voltage for a column of pixels can be described as:

$$V^2_{RMS}(i)=\frac{1}{N}\left[V_r^2\sum_{t=0}^{N-1} W^2(i,t)+V_c^2\sum_{t=0}^{N-1} T^2(t)-2V_rV_c\sum_{t=0}^{N-1} W^2(i,t)T(t)\right]. \tag{5}$$

Note that $W^2(i,t)$ is always equal to one and that the relationships in equation (3) can be substituted for the last two terms, simplifying equation (5) to:

$$V^2_{RMS}(i)=\frac{1}{N}\left[NV_r^2+\frac{V_c^2}{N}\sum_{i=0}^{N-1} P^2(i)-2V_rV_cP(i)\right]. \tag{6}$$

If the pixels are restricted to having only the values of plus or minus one, the second term of equation (6) is a constant, and the average square activation voltage is simply:

$$V^2_{RMS}(i)=\tfrac{1}{N}[NV_r^2+V_c^2-2V_rV_cP(i)]. \tag{7}$$

Thus, since N, $V_r$ and $V_c$ are constants, the activation seen by the LCD material is proportional to the desired pixel voltage, P(i).

The performance of the LCD panel is improved using transform addressing because the binary basis vectors can be chosen so that statistically the binary basis vectors do not tend to correlate highly with any pixel column vectors found in typical television and computer images. In other words, the transform values of T(t) will seldom exceed given statistical voltage bounds for common pictures. In turn, this observation implies that the pixels receive excitation in many small increments, instead of one large pulse, as is the case with row-at-a-time addressing. Accordingly, the effective excitation voltage ripple on the LCD material is significantly smaller for the transform addressing method as compared to conventional row-at-a-time addressing.

The speed limitations of row-at-a-time addressed LCDs result from the large activation decays associated with the 5 single large addressing pulse that all pixels receive each refresh period. By distributing the excitation each pixel receives throughout the frame refresh period, the optical output decay or ripple for each pixel is significantly smaller. Thus, liquid crystal materials with shorter response times may be used without suffering contrast degradation characteristic of the 'frame response' problem.

II. RMS Correction Terms

In the case of grayscale pixels that can take on any value between −1 and +1, however, the $$\sum_{i=0}^{N-1} P^2(i)$$

term in the average square activation equation:

$$V^2_{RMS}(i)=\frac{1}{N}\left[NV_r^2+\frac{V_c^2}{N}\sum_{i=0}^{N-1} P^2(i)-2V_rV_cP(i)\right], \tag{8}$$

is not a constant and thus introduces an error term into the RMS excitation. The LCD addressing approaches described by the Nehring and Kmetz, as well as Scheffer and Clifton, are valid only for on/off or binary pixels. The present invention provides methods and apparatus for achieving grayscale pixel operation by calculating RMS correction terms.

The RMS correction terms are calculated by determining an offset for the $$\sum_{i=0}^{N-1} P^2(i)$$

term in Equation (8). This term has a maximum value of N and a minimum value of zero for pixel magnitudes of one or less. The present addressing approach contemplates adding a constant value to all pixels in a column by driving all row electrodes to a constant value, while at the same time driving each column electrode with a voltage that has a voltage represented by $$N-\sum_{i=0}^{N-1} P^2(i)$$

which voltage is added to the RMS activation. Adding this voltage exactly cancels the effect of the $$\sum_{i=0}^{N-1} P^2(i)$$

term.

The RMS correction term, $V_{RMSCorrect}$, adds an extra row/column presentation cycle that results in an RMS excitation and the RMS excitation voltage can be expressed as the equation:

$$V^2_{RMS}(i)=\frac{1}{N+1}\left[NV_r^2+\frac{V_c^2}{N}\sum_{i=0}^{N-1} P^2(i)-2V_rV_cP(i)+(V_r-V_{RMSCorrect})^2\right]. \tag{9}$$

Equation 9 can be expanded to:

$$V^2_{RMS}(i)=\frac{1}{N+1}\left[(N+1)V_r^2+\frac{V_c^2}{N}\sum_{i=0}^{N-1} P^2(i)-2V_rV_cP(i)-2V_rV_{RMSCorrect}+V^2_{RMSCorrect}\right]. \tag{10}$$

The RMS correction term is chosen to 'fill out' the total RMS activation in order to cancel the effect of the $$\sum_{i=0}^{N-1} P^2(i)$$

term. By setting the following condition:

$$\frac{V_c^2}{N}\sum_{i=0}^{N-1} P^2(i) - 2V_rV_rV_{RMSCorrect} + V_{RMSCorrect}^2 = V_c^2, \tag{11}$$

the total RMS activation becomes independent of the $$\sum_{i=0}^{N-1} P^2(i)$$

term:

$$V_{RMS}^2(i) = \frac{1}{N+1}\,[(N+1)\,V_r^2 + V_c^2 - 2V_rV_cP(i)]. \tag{12}$$

Equation 11 is a quadratic equation with the solution:

$$V_{RMSCorrect} = V_r \pm \sqrt{V_r^2 + V_c^2 - V_c^2\sum_{t=0}^{N-1} T^2(t)}\ . \tag{13}$$

To compensate for the RMS error term, a constant offset is added to all pixels by driving all row lines high and driving the column line with the signal, $V_{RMSCorrect}$, as specified in Equation (13). This $V_{RMSCorrect}$ term exactly compensates for the RMS error and results in an average square activation voltage of:

$$V_{RMS}^2(i) = \frac{1}{N+1}\,[(N+1)\,V_r^2 + V_c^2 - 2V_rV_cP(i)]. \tag{14}$$

The RMS correction term, $V_{RMSCorrect}$, cannot simply be driven onto the column electrodes at the end of each frame refresh period, since the magnitude of the correction signal is typically much larger than the transform signals. Driving such a large signal onto the column lines would result in a significant 'frame response' problem.

One solution is to break the RMS correction term into a number, $K_{Max}+1$, of smaller terms and distribute the terms throughout the frame refresh period. The present invention contemplates calculating $K_{max}+1$ partial correction terms, that follow the form of Equation (13):

$$V_{RMSCorrect}^{(k)} = \sqrt{V_r^2 + V_c^2\left[S_{max} - \sum_{t=k(N/K_{max})}^{(k+1)(N/K_{max})} T^2(t)\right]} + V_r, \tag{15}$$

wherein $S_{max}$ is chosen to be a constant large enough to ensure that $v^{(k)}_{RMSCorrect}$ is non-imaginary These RMS correction terms are driven onto the column electrodes and are evenly distributed throughout the frame refresh period.

By dispersing the RMS correction terms throughout the frame refresh period, the 'frame response' problem associated with one large RMS correction pulse is avoided. When $S_{max}$ is not large enough to prevent an imaginary correction result, the square root term of Equation (15) may be set to zero and the remainder of the partial sum of squared transform results carried over to the following correction term. This method is defined herein as the 'remainder carry-over method'. In either case, the pixel activation can be computed by adding the effect of the RMS correction terms into Equation (8), resulting in the equation:

$$V_{RMS}^2(i) = \frac{1}{N+K_{max}}\,[(N+K_{max})\,V_r^2 + V_c^2K_{max}S_{max} - 2V_rV_cP(i)]. \tag{16}$$

Thus, $V_{RMS}^2$ (i) is proportional to the desired pixel value plus a constant.

Since the relative magnitude of the terms in Equation 16 determines the maximum attainable RMS voltage swing across a pixel, the first two constant terms should be minimized in relation to the pixel information term. The ratio of 'on' to 'off' pixel voltages is commonly referred to as the 'selection ratio' and is a measure of the required sharpness of the LCD light-to-dark transition as a function of voltage. If $V_r$ and $V_c$ are chosen so as to maximize the selection ratio, the selection ratio is simplified to:

$$\frac{V_{RMS}^{on}}{V_{RMS}^{off}} = \sqrt{\frac{\sqrt{K_{max}S_{max}(N+K_{max})} + 1}{\sqrt{K_{max}S_{max}(N+K_{max})} - 1}}\ . \tag{17}$$

The selection ratio prescribed by the present addressing method requires that the liquid crystal material transition from light to dark states within a given voltage range. Since liquid crystal materials with sharp light-to-dark transitions are difficult to manufacture, the selection ratio should be maximized to permit the use of liquid crystal materials that do not have sharp light-to-dark transitions. By minimizing $S_{max}$, the selection ratio is maximized. Thus, reducing $S_{max}$ through the use of the remainder carry-over method permits the use of a greater variety of liquid crystal materials.

A second method for RMS correction also can be utilized to compensate for the crosstalk term found in Equation 8. This second method involves calculating two transform terms for each pixel value and driving combinations of these two terms onto the LCD electrodes in two phases. Thus, two signals per pixel are driven onto the column electrodes and the two signals are chosen to cancel the RMS error term.

Using the definitions found in Equations (5)–(7), one of the calculated terms is proportional to the pixel value, P(i), while the other term is proportional to $\sqrt{1-P^2(i)}$. The $\sqrt{1-P^2(i)}$ function can be computed in a number of ways, including a digital lookup table or an analog voltage-to-voltage converter.

The transform computation is divided into two phases. In the first computation phase, the $\sqrt{1-P^2(i)}$ term is added to the P(i) term and then multiplied by the particular binary transform coefficient, W(i,t). This operation results in one transform of the pixel column P'(i), wherein P'(i) is defined as:

$$P'(i) = P(i) + \sqrt{1-P^2(i)}\ . \tag{18}$$

The resulting column voltage is driven onto the column lines of the LCD and that signal is proportional to the transform of P'(i):

$$T'(t) = \frac{1}{N}\sum_{i=0}^{N-1} W(i,t)(P(i) + \sqrt{1-P^2(i)}\ ). \tag{19}$$

In the second phase of the computation, the $\sqrt{1-P^2(i)}$ term is subtracted from P(i) to generate a second transform term, P"(i). A voltage representative of this second transform term is then driven onto the column lines of the LCD and that second signal is proportional to the transform of P"(i):

$$T''(t) = \frac{1}{N}\sum_{i=0}^{N-1} W(i,t)(P(i) - \sqrt{1-P^2(i)}\ ). \tag{20}$$

Following the mathematics of Equations (9)–(11), the total RMS excitation seen by the ith pixel in one column can be expressed by the equation:

$$V_{RMS}^2(i)=\frac{1}{2N}\left[2V_R^2\sum_{t=0}^{N-1}W^2(i,t)+V_C^2\sum_{t=0}^{N-1}(T'^2(t)+T''^2(t))-2V_CV_R\sum_{t=0}^{N-1}W(i,t)(T'(t)+T''(t))\right]. \quad (21)$$

Combining equation (21) with the following derivations:

$$\Sigma(T'^2(t)+T''^2(t))=2 \text{ and} \quad (22)$$

$$P''(i)+P'(i)=2P(i), \quad (23)$$

and substituting the relations used in equation (3) above, results in an RMS pixel excitation of:

$$V_{RMS}^2(i)=\frac{1}{2N}\,[2NV_R^2+2V_C^2-4V_CV_RP(i)]. \quad (24)$$

Thus, comparing equation (24) to equation (8), the second or crosstalk term of each equation becomes a constant using this addressing method, thereby eliminating the RMS error. The square RMS voltage is now linearly proportional to the pixel value, P(i). This square relationship results in a nonlinearity between the analog input voltage and the RMS voltage as seen by the LCD pixels. However, since the liquid crystal material itself is highly nonlinear, additional distortions make a linear relationship between input signal and RMS pixel voltage non ideal. These added nonlinearities can be compensated for in the present system by providing an arbitrary distortion generator on the pixel input that not only computes the P'(i) and P"(i) distortion terms, but also takes into account the specific LCD nonlinearities and other nonlinearities, such as gamma correction.

Figure 8:
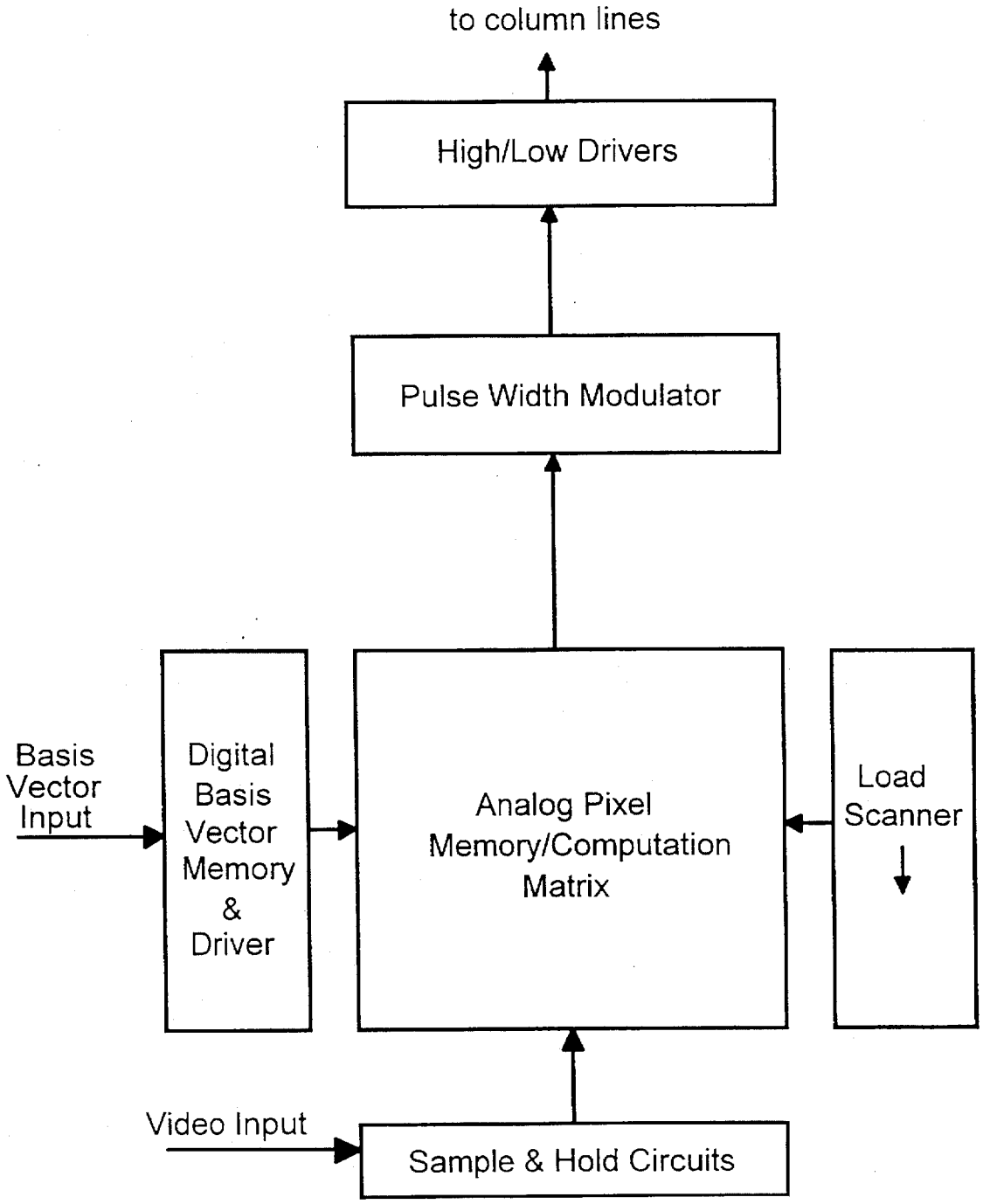
FIG. 8 is a block diagram of a pulse width modulated enhanced addressing column driver.

Other methods also may be utilized for RMS compensation without departing from the spirit of the present invention, including driving the column electrodes with pulse width modulated (PWM) signals. A PWM signal can be a constant amplitude signal whose sign changes at an appropriate time to encode a variable signal. This method is commonly used to drive column lines in row-at-a-time addressed displays. However, transform addressing with PWM column drivers requires a larger column voltage range than row-at-a-time addressing due to the statistical variance of the transform results. A sufficiently large magnitude PWM signal can subsequently add a significant constant term to the expression for RMS voltage and reduce the selection ratio significantly. In addition, the timing accuracy of the PWM signal would be resistance LCD electrodes, which act like transmission lines. FIG. 8 shows a block diagram of a pulse width modulated enhanced addressing column driver constructed according to the present invention.

Figure 9:
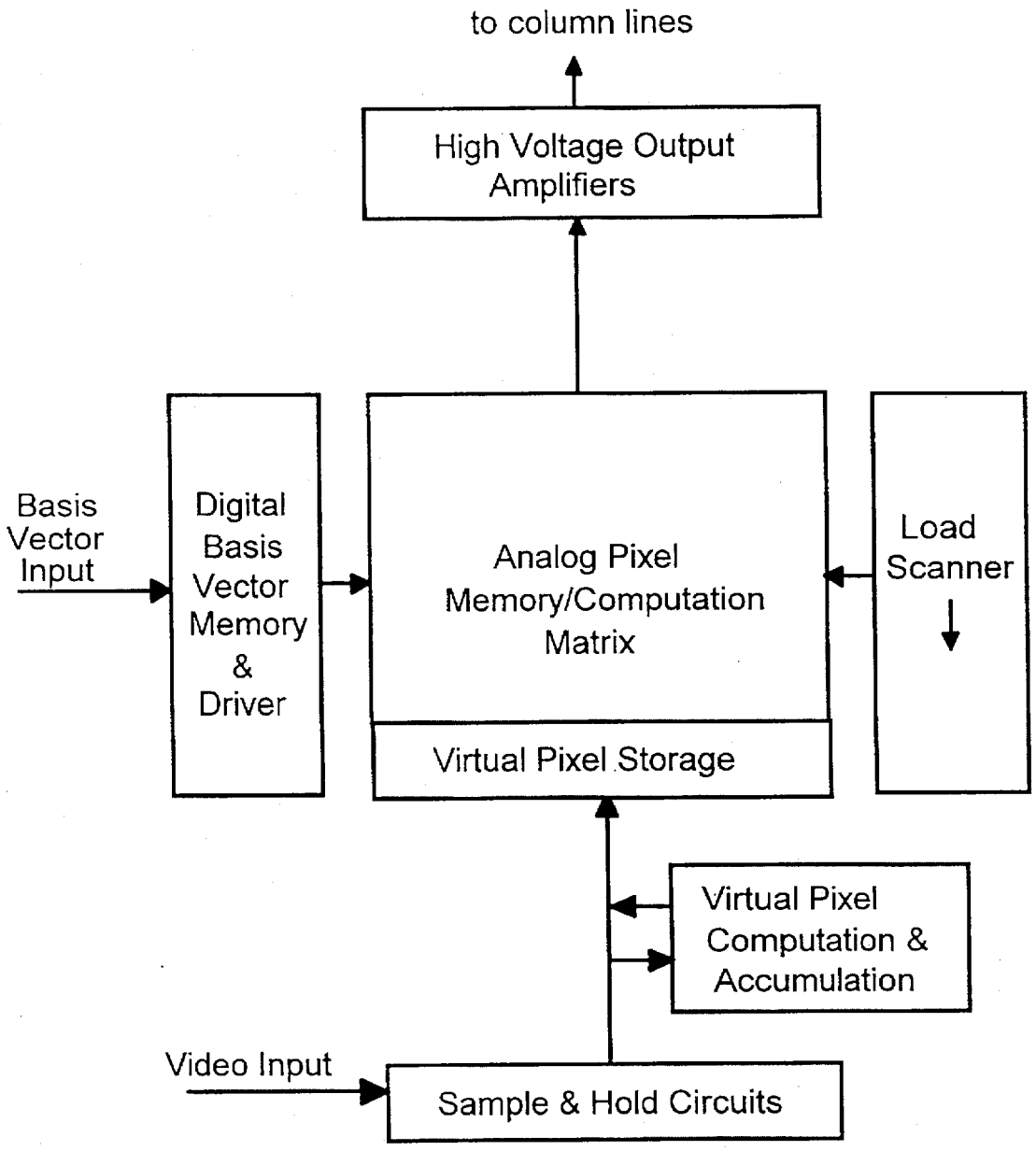
FIG. 9 is a block diagram of a pulse height modulated enhanced addressing column driver.

Another method for compensating for the RMS error is to add a constant offset to all transform signals driven onto the column lines, as described in A. R. Conner and T. J. Scheffer, 'Pulse-Height Modulation (PHM) Gray Shading Methods for Passive Matrix LCDs,' in *Proceedings of the 12th International Display Research Conference*, pp. 69–72, 1992. This method requires precomputing one or more virtual pixel values prior to displaying an image. However, as a result of this requirement, the memory bandwidth required to perform this operation is significant. FIG. 9 shows a pulse height modulated enhanced addressing column driver constructed according to the present invention.

III. Analog Pixel Matrix

The binary transform and RMS correction computations are performed by the transform column driver circuits (7) of the present invention. Referring to FIG. 1, in applicant's preferred embodiment, the row drivers are loaded with the binary basis vectors of the chosen linear transform from the binary basis vector generator (5) through a communication link (9). As used herein, a link or line is simply a means for connecting two or more components.

A binary basis suitable for transform addressing can be generated using a number of well known methods for Walsh function generation. Such methods are discussed in Beauchamp. Additionally, preferred binary basis generating Beauchamp. Additionally, preferred binary basis generating functions or entire transform matrices may be stored in semiconductor memories that can be accessed by or stored on the binary basis vector generator IC (5).

The transform column drivers (7) are also loaded with the same basis vectors through a communication link (10). Video information is loaded from source (8) into the transform column drivers (7) through a link (12) that is connected to all of the transform column drivers.

When a binary basis vector is highly correlated with the pixel matrix it may be desirable to change to a different binary transform. If this event occurs, the transform column drivers can signal the binary basis function generator through link (11) to switch to a different binary basis. The different binary basis vector can be randomly generated in real time or can be chosen from a selection of basis vectors stored in a permanent memory, for example.

Figure 2:
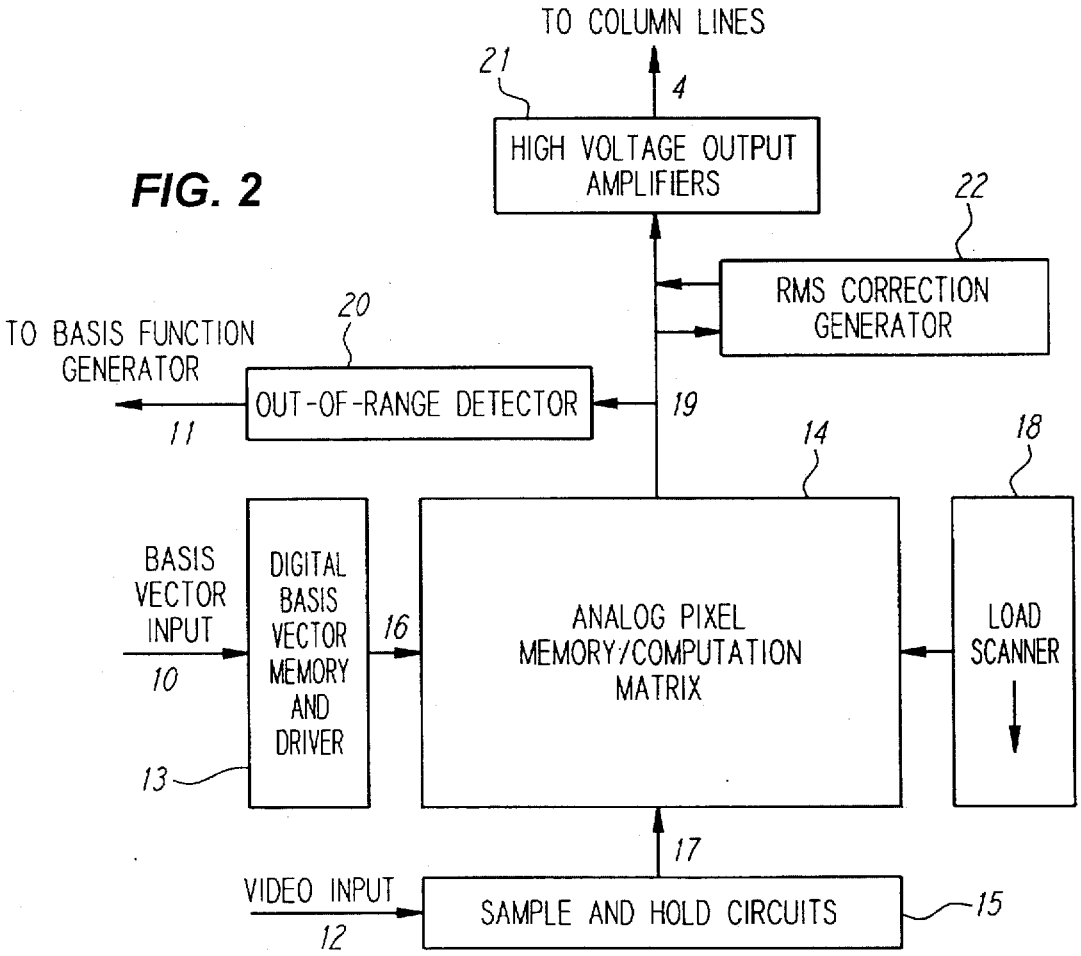
FIG. 2 is a functional block diagram of a transform addressing column driver IC. This figure contains, among other things, an analog pixel memory/computation matrix that stores video information and computes the binary transform of the stored video information as required by the transform addressing method. A set of monolithically integrated high voltage amplifiers is also included to drive the column lines of the LCD directly.

Each transform column driver, as shown in FIG. 2, has digital memory storage (13) for storing at least one binary basis vector and an array of analog storage cells (14) that contain analog pixel matrix storage circuits. The analog pixel matrix circuitry (14) also computes the video image transform, which transform is the vector-matrix multiplication of the binary basis vector and the values that represent the video image or pixel information and are stored in the analog pixel matrix.

Pixel information is loaded into the analog pixel matrix through a set of sample-and-hold circuits (15) that capture a row of pixel information out of the video input data stream (12). For analog video applications such as televisions, sample-and-hold circuits alone are appropriate. For computer applications that have digital video streams, a combination of conventional digital memories, digital-to-analog converters (DACs) and sample-and-hold circuits may be used to provide the same capture function.

Voltages proportional to the captured row of pixel information are driven onto the vertical lines of the analog pixel matrix through link (17) and the pixel information is loaded into the proper row of the array. The pixel information is stored as charge packets in the analog pixel matrix. The particular row that is loaded is controlled by a load scanner (18). The load scanner (18) is capable of continuously cycling through all rows in synchrony with the incoming video signal. The load scanner (18) can perform interlaced video loading by alternately loading all even lines and then loading all odd lines in synchrony with the incoming interlaced video. Alternatively, a random access digital address decoder can be used to select the row of analog pixel cells to be loaded.

As a precursor to computation, a binary basis vector is loaded into the digital basis vector storage (13). The binary basis vector information is driven onto horizontal wires into the analog pixel matrix (16) and is multiplied with the values stored in the analog pixel matrix to produce an analog transform output (19).

Although not essential to the invention, an optional out-of-range detector (20) can be used to determine if any of the analog transform outputs exceed a preset correlation threshold. If the preset correlation threshold is exceeded, the basis function generator (5) in FIG. 1 can switch to a different binary basis vector, once the current frame refresh period is completed. The out-of-range detector can be constructed using conventional comparator circuits with the outputs logically combined to provide a signal that indicates whether any transform signals exceed a preset correlation limit.

The analog transform outputs can be connected to a set of high voltage amplifiers (21) that are capable of driving the column electrodes directly. A circuit block capable of computing RMS correction terms (22) also may drive the high voltage amplifiers.

Figure 3:
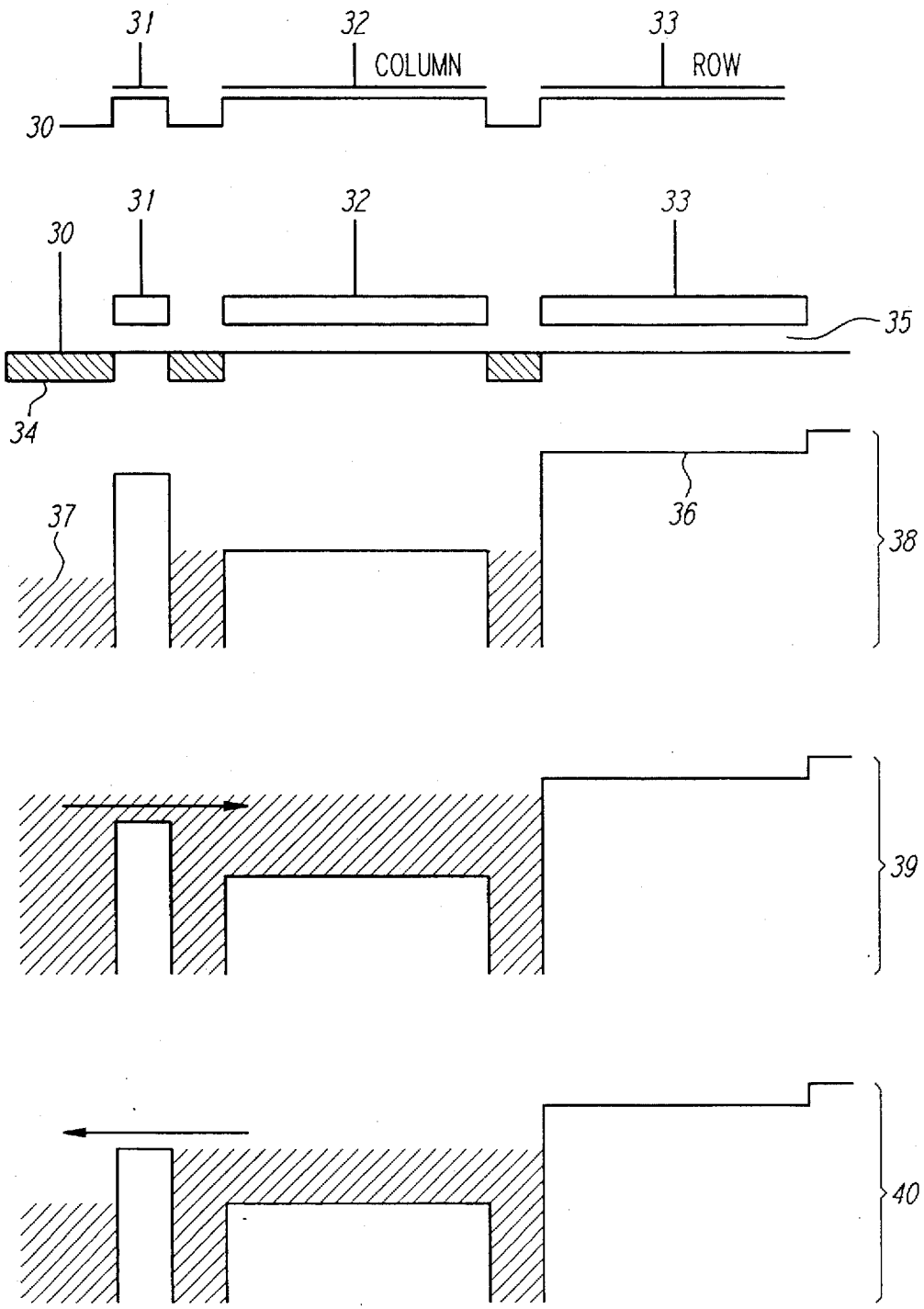
FIG. 3 depicts a schematic, a cross-section and electron potential diagrams pertaining to the loading operation of the analog pixel matrix cell. Each cell is comprised of three n-FETs that are connected in series. In the electron potential diagrams, increasingly positive voltages applied to the gates of the FETs create deeper wells for electrons in the substrate underneath the gates of the FETs.
Figure 4:
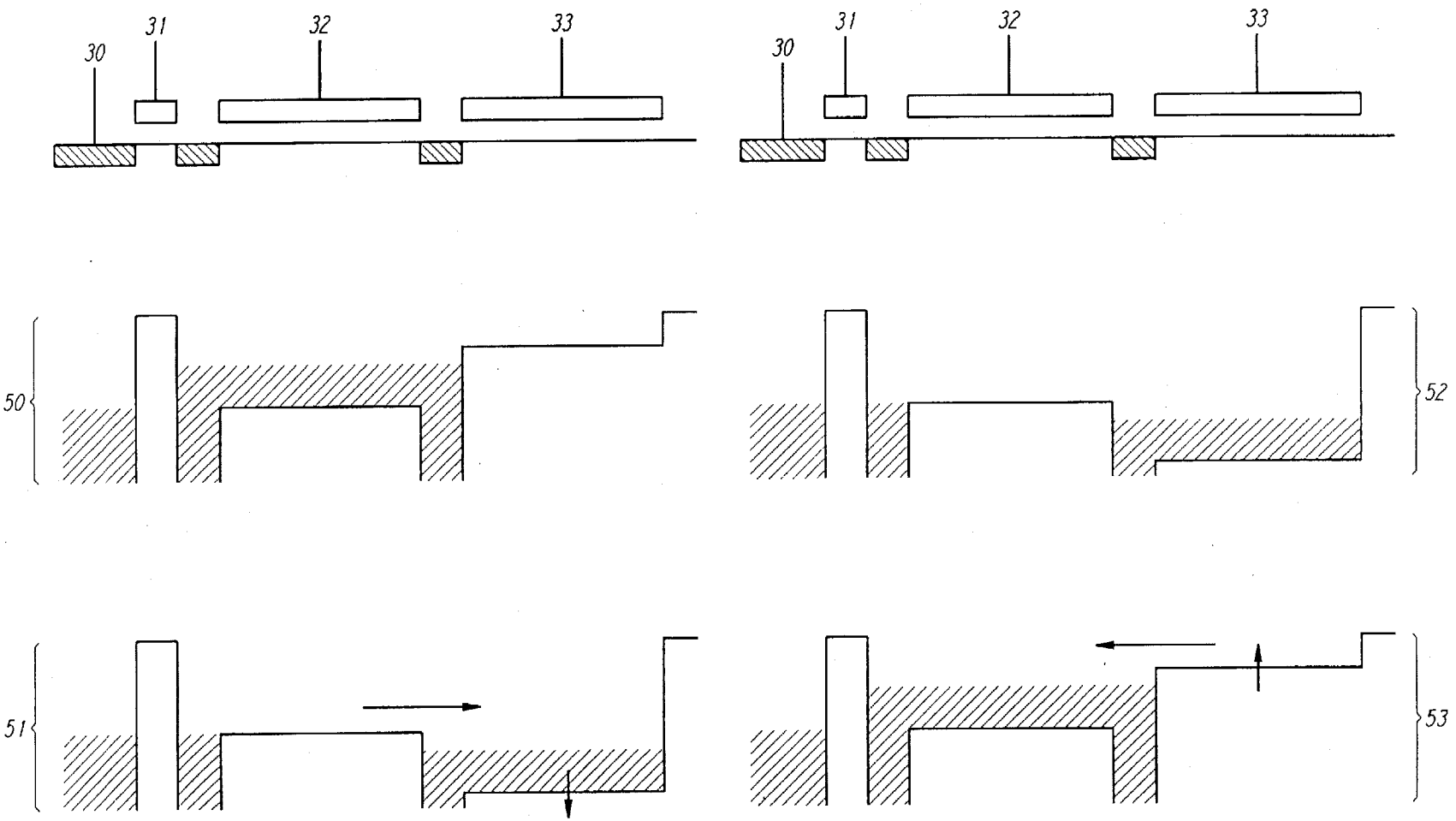
FIG. 4 depicts additional electron potential diagrams of the analog pixel matrix cell that illustrate the computation operation when the charge stored in each cell is added or subtracted from the column sense line.

The analog pixel matrix cell can be fabricated in a variety of semiconductor fabrication technologies. The preferred technology is single polysilicon CMOS, simply because it is the least expensive process and is widely available. Those skilled in the art will recognize that other fabrication technologies also can be used successfully, such as double polysilicon CMOS, with slight modifications to the cell layout for improved performance. The preferred analog pixel cell is shown in FIGS. 3 and 4. These cells can be arranged in the organization shown in FIG. 5.

Figure 5:
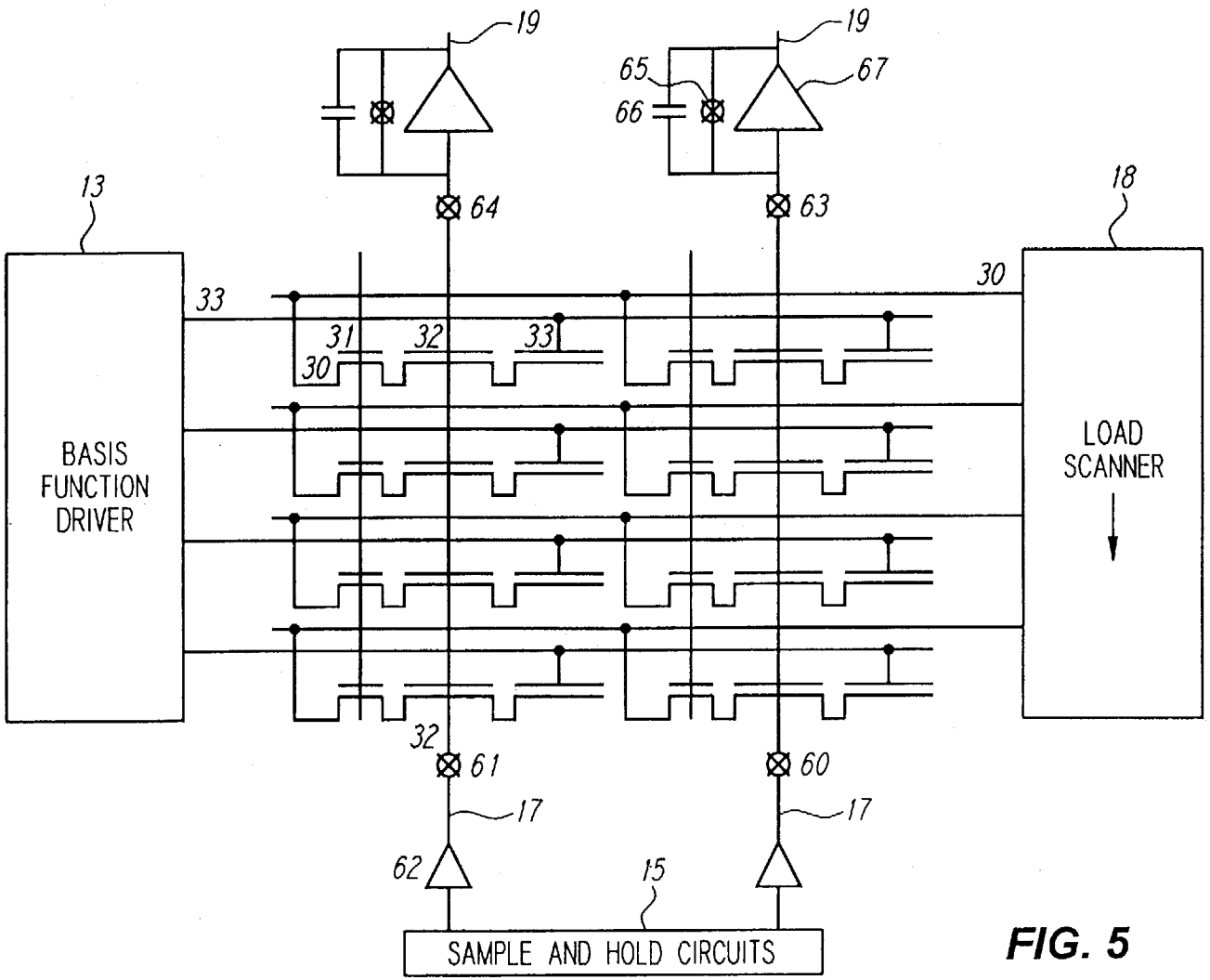
FIG. 5 shows a two by four array of analog pixel matrix cells with additional charge sensing and loading circuitry. The simplified charge sense amplifier (67) senses the charge transferred beneath the input line and creates a voltage proportional to the binary transform of the analog pixel matrix information.

Referring to FIG. 5, the operation of the device can be broken into two distinct phases—loading video information into the memory array and computing the transform. For simplicity in describing the operation of the present invention, FIG. 5 shows a two by four array of analog pixel matrix cells with additional charge sensing and loading circuitry. The architecture described herein is, of course, not limited to such a small array, as a 192 output transform column driver IC would typically have a 192 by 512 analog pixel matrix.

During the first phase of the operation, video information is loaded into the analog pixel matrix. Specifically, the video information is loaded into the sample and hold circuits (15) that capture a segment of the video information, which segment consists of one horizontal row of pixels from the incoming video data stream (12). These pixel values are represented as voltages on lines (17). Those skilled in the art will recognize that a number of different sample and hold circuits can be used to practice the present invention, depending upon design considerations such as speed, size, power dissipation and accuracy.

During the load phase, switches (60) and (61) are closed and switches (63) and (64) are open. The voltage on line (32) is driven by buffer (62) and is proportional to the pixel value to be loaded. The load scanner (18) keeps track of which video line is being loaded. In this example, the video line being loaded is the top row of the array of analog pixel matrix cells in FIG. 5.

Referring to the circuit representation of FIG. 3, a simplified physical cross-section and a set of electron potential diagrams of the analog pixel matrix cell are shown. The circuit has four external connections (30–33) and consists of three n-channel FETs that are connected in series. The construction of the analog pixel matrix can best be understood by reviewing FIGS. 3 and 5 together. Two horizontally connected electrodes (30, 33) are driven from the vertical edges of the array, one electrode (30) is for loading pixel charges into a particular row of the analog pixel matrix and the other electrode (33) is for driving basis vector information into the array for computation purposes. One vertically connected electrode (32) is used to set the pixel charge level during loading and to sense the product of the binary basis vector and analog pixel matrix during the computation phase. The other vertically connected electrode (31) is used to prevent charge from escaping once it has been loaded into the array.

The physical cross-section in FIG. 3 shows the three n-FETs and the source/drain regions of each FET. Each FET has a source, gate and drain terminal. Note that the last FET (33) in the series has only one source/drain terminal. FET (33) is equivalent to a three terminal FET in which the source and drain are connected together. Those skilled in the art will recognize that a FET can have one or more source/drain terminals.

The gates of the analog pixel matrix cell of FIG. 3 sit above the substrate, separated from the analog pixel matrix cell by a thin gate oxide (35). The particular layout of the analog pixel matrix cells is not important for the present discussion, but does have important design implications in terms of noise, area and accuracy. Those skilled in the art will recognize that numerous modifications can be made to the analog pixel matrix cell described herein that will result in the same functionality. Such modifications include the use of a double polysilicon structure, additional FETs, differential analog pixel matrix cells and additional horizontally and vertically connected electrodes. These modifications are application dependent and are to be considered within the scope of the present invention.

The electron potential diagrams (38–40) below the cross-section of FIG. 3 are a convenient way to view the operation of one analog pixel matrix cell. In these drawings, increasingly positive voltages on the gates of FETs (31–33) create deeper wells for electrons in the substrate underneath the respective FETs. To load the cell (as shown in diagram (38)) the potential well is initially set by placing the proper fixed voltages on electrodes (30), (31) and (33). The column gate voltage (32) is driven by the video sample and hold circuits (15) and is proportional to the pixel value that will be loaded. In diagram (39), the source of the first FET (31) is pulsed to a low voltage, thereby driving electrons into the cell. When gate (31) is returned to a more positive voltage, the charge remaining under the column gate (32) is proportional to the gate voltage, as shown in diagram (40). A larger voltage on gate (32) would create a deeper well that, when FET (31) is pulsed low, would fill with more charge. This operation, commonly referred to as the "potential equilibration technique," is used in charge coupled devices (CCDs) to create variable size packets of charge. See, e.g., J. D. E. Beynon and D. R. Lamb, Charge-Coupled Devices and Their Applications, McGraw-Hill, London, 1980. Thus, by varying the voltage on gate (32), varying charge packets can be created under the gate and the charge packets are proportional to the gate voltage on FET (32).

Once the charge is loaded, gate (31) is pulsed to a low voltage to prevent charge from escaping from the cell to source electrode (30). In this manner, an entire row of the analog pixel matrix is loaded with pixel information captured out of the video stream. The pixel information resides as charge packets in the analog pixel matrix cells.

Those skilled in the art will recognize that numerous modifications can be made to the loading procedure described above without departing from the spirit of the invention. For example, a variation of the potential equilibration technique known as the 'pulsed gate' or 'diode cut-off' technique (Beynon and Lamb, p. 186) involves driving the source terminal of the first FET with the pixel voltage level and scanning the gate of the second transistor, while pulsing the gate of the first transistor. In this implementation, the source terminals of the analog pixel matrix cells are vertically connected and driven with the pixel information. The gate terminals of the first FETs of each cell are common between all cells in the matrix. The gate terminals of the second FETs of each cell are horizontally connected between cells and are driven by a row scan and basis vector signal. The gate terminals of the third FETs of each cell are vertically connected to the charge sense amplifiers. Thus, the horizontal and vertical connectivity of the analog pixel matrix shown in FIG. 3 can be substantially modified and still perform the same function.

Any of the load schemes described in Beynon and Lamb, including the potential equilibration technique, the diode cut-off technique, the feedback linearization technique and the dynamic current technique, can be used to create a matrix of analog values stored in the analog pixel matrix of the present invention. Each of the different loading techniques requires different voltages, connectivity and possibly a different number of FETs per analog pixel matrix cell. Those skilled in the art will recognize the high degree of freedom possible when designing the analog pixel matrix cell and the resulting electrode connectivity and driving waveforms required for operation.

Additionally, a double polysilicon CMOS fabrication process can be used to implement the analog pixel matrix cell. In that case, the analog pixel matrix can operate in a mode similar to surface channel CCDs, as described in Beynon and Lamb. Furthermore, the analog pixel data may be stored as charge on a polysilicon capacitor that modulates the conductance of a FET, as in the neural network circuit described in F. J. Kub, K. K. Moon, I. A. Mack and F. M. Long, 'Programmable Analog Vector-Matrix Multipliers,' *IEEE Journal of Solid State Circuits*, Vol. SC-25, No. 1, pp. 207–214, 1990. The conductance modulated FET connects row and column lines, possibly employing more FETs (such as a differential pair) for each analog pixel matrix cell, and computes the vector-matrix product of the analog pixel matrix data and the data on the row lines. Therefore, those skilled in the art will recognize that a particular electrode arrangement of a particular mode of computation is not essential to practice the present invention.

Two potential sources of computation error in this analog charge storage scheme are manufacturing variations that result in transistor offset voltages and charge leakage problems. An offset voltage on either gate (31) or gate (32) results in a charge packet offset. This charge packet offset will result in fixed pattern noise on the display. For typical fabrication processes, the transistor offsets are typically in the range +/−30 mV. Since the available range of pixel input voltages is approximately 2V, the offsets can reduce the computation accuracy by one part in 30, or to roughly 5 bits. For most color applications, including television, this level of computation accuracy is adequate and the human eye will not notice the error. For higher levels of accuracy, a feedback loading scheme similar to those discussed in Beynon and Lamb, p. 200, can be used that would eliminate the effect of transistor offsets.

The stored charge packets are refreshed once per frame period. For the National Television Standards Committee (NTSC) television frame rate of 30 Hz, the charge packet accuracy is required to be maintained for approximately 30 msec. Temperature dependent substrate leakage currents gradually increase the magnitude of the stored charge packets. At room temperature, tested circuits show a temperature dependent error of less than 30 mV per cell, which error is on the order of transistor threshold errors and hence can be neglected. Due to the limited temperature range that liquid crystal materials are typically exposed, the transform driver ICs of the present invention are not required to work at the elevated temperatures that many typical ICs must endure. Furthermore, the charge increase is typically uniform across the array. Thus, the charge increase induces an error only in one transform result that can be easily compensated for by a brightness control as described below.

Moving to the computation phase of the analog pixel matrix operation, the binary transform computation requires multiplication by +/−1 only (or perhaps multiplication by zero in the case of a ternary basis vector). Referring to FIG. 5, the computation phase of the operation requires that switches (60) and (61) be open and switches (63) and (64) be closed. A simplified charge sensing amplifier (67) with capacitive feedback (66) is reset by the successive closing and opening of switch (65). This operation serves to set the column lines (32) to an intermediate voltage, shown in FIG. 4 as diagrams (50) and (52). The binary basis vector elements determine the state of the row line (33) during the amplifier reset phase. If the basis vector element (BVE) is a +1, the corresponding row line is kept at a positive voltage (52) and the charge is thus maintained under the row gate. If the BVE is a −1, the row line is kept at a negative voltage (50) and the charge is thus maintained under the column gate. With the reset switch (65) open, the row lines are sensitive to charge moved beneath them in a manner similar to CCD charge sensors. An analysis of CCD charge sensor operation is discussed in Beynon and Lamb, p. 189.

Computation occurs when reset switch (65) has been opened and the BVE lines are all reversed in polarity. This operation results in +1 BVE row lines transferring charge under column gates (53) and −1 BVE row lines removing charge from under column gates (51). This operation effectively multiplies the charge packets by +/−1. For multiplication by zero, the relevant BVE row lines are not reversed in polarity. The charge sense amplifier (67) senses the total charge moved beneath the column line (32) and creates a voltage output on line (19) for each column line. The voltage output is the video transform result and more specifically, is the dot product of the analog pixel matrix charge and the binary basis vector. When the computation is complete, the amplifiers are reset and the charges are moved back beneath the proper gates in preparation for the next computation or load cycle.

Thus, computation of the binary transform of the analog pixel matrix is performed in parallel. The analog pixel values are represented as charge packets stored beneath the gates of the CMOS FETs in the pixel matrix. The charge packets can be multiplied many times without loss of information due to the charge conservation properties of CMOS FETs. Each three transistor analog pixel matrix cell performs storage, multiplication and summing operations.

Loading the matrix, as described above, is a separate phase of the operation of the circuit. For most systems, video information is in the form of a constant stream of data. Load and compute phases can be interleaved so that one row is replaced with new pixel data between computations. However, since the video image may be changing rapidly, the new pixel data causes the linear transform to be a hybrid of the old frame and the new frame. Computational artifacts may result in reduced picture quality, especially with rapid scene changes.

To eliminate this overlap problem, incoming video can be stored in a first analog pixel matrix while the computation is done on the data in a second analog pixel matrix. Once the first analog pixel matrix is filled with the new frame of pixel data and the computation of the second analog pixel matrix finishes, the video data stream is directed to the second analog pixel matrix while the computation hardware operates on the data in the first analog pixel matrix. This arrangement, commonly referred to as a 'ping-pong' memory architecture, is used in many video processing systems. Those skilled in the art will recognize the flexibility available in choosing the clocking sequence and memory architecture.

For an analog pixel matrix cell with no charge, the parasitic capacitance between the BVE line (33) and the charge sense line (32) will result in a non-negligible effective charge transfer. To avoid this charge transfer problem, the number of +1 basis elements can be set equal to the number of −1 basis elements in each basis vector so that the net charge injected by parasitic capacitive coupling is zero. This restriction on basis vectors does not diminish the beneficial statistical properties of transform addressing. One method of generating a binary transform matrix that satisfies this restriction is to randomly swap the rows of a Walsh Transform matrix. All basis vectors except the lowest order frequency component, i.e. the DC term, then have equal numbers of +/−1 elements. Any uniform error charge generated by thermal mechanisms over the frame refresh period only changes the lowest order frequency component, i.e. the DC term.

Figure 6:
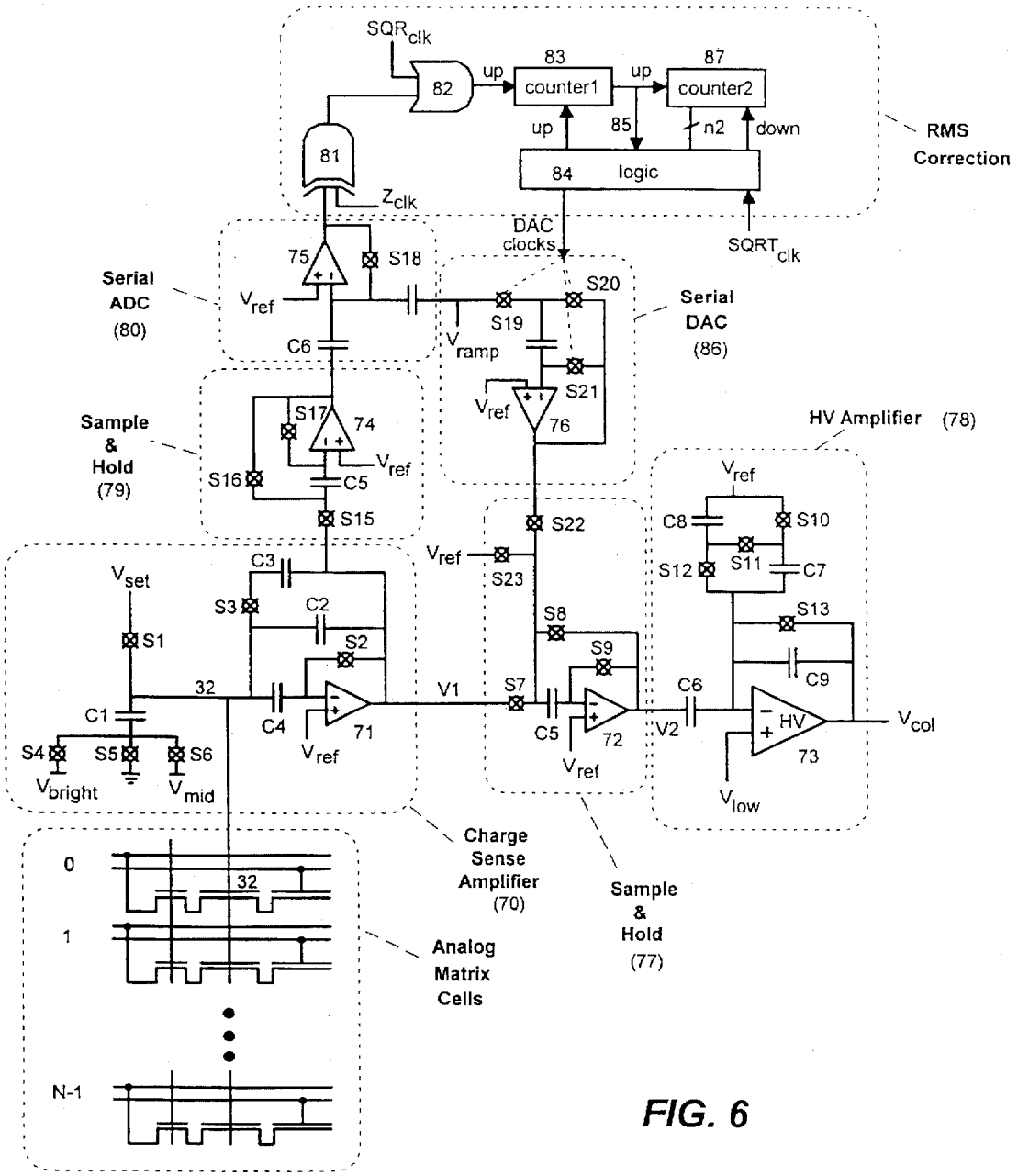
FIG. 6 is a detailed schematic of the charge sensing, RMS error computation and high voltage output circuitry associated with one column of the analog pixel matrix.

The DC transform term is typically much larger than the other transform terms. To avoid 'frame response' or out-of-range problems, the DC term is divided and driven onto the LCD display as smaller terms distributed throughout the frame period. This addressing method is similar to the methods used for the RMS correction terms. Referring to FIG. 6, the division occurs by switching in a larger capacitor, C3, into the feedback loop of the charge sensing amplifier (70). The relative size of the two capacitors in the feedback loop, C2 and C3, controls the amount of division applied to the DC term and hence the number of DC terms. To offset the parasitic coupling charge associated with the DC term (since there are not equal numbers of +1 and −1 basis vector elements), a charge injection capacitor, C1, is switched between ground and an intermediate voltage, $V_{bright}$, by the operation of switches S4 and S5 to inject charge onto the sense line (32) equal to:

$$Q_{inj}=C_1V_{bright} \tag{25}$$

Since $V_{bright}$ specifies the DC offset of the entire display, $V_{bright}$ can be used as a brightness control that can be adjusted by the viewer.

The transform results of the present invention can be sequenced to provide alternating polarity output signals that are guaranteed to have a zero average voltage, thereby preventing damage to the LCD. This feature is in contrast to the prior art, such as the apparatus disclosed in EP0507061A2 which relies upon statistical interpretation to prevent DC damage to the LCD. Thus, in previous devices DC damage could not be guaranteed. Furthermore, by attenuating and distributing the large DC term over the entire frame period, the present invention avoids any of the 'frame response'-like problems associated the DC term that are typically encountered with the enhanced addressing schemes.

Those skilled in the art will recognize a number of modifications to this basic architecture that would allow for differential operation. Differential operation can result in the cancellation of the parasitic capacitive coupling effects and removal of the requirement that the number of +1 basis vector elements be equal to the number of −1 basis vector elements. Subsequently, the DC component of the transform can be statistically spread between all basis vectors of the transform. One method of creating such a transform involves inverting rows of the transform matrix, which has the binary basis vectors as its columns. Such an inverting operation does not change the orthonormal properties of the transform. By spreading the DC component throughout all transform results, the 'frame-response' problem of a large single DC pulse is avoided.

The feedback charge sense amplifier (67) of FIG. 5 can be replaced by a specialized charge sense amplifier (70) shown in FIG. 6, although other charge sense amplifier configurations can be used as well. FIG. 6 shows one column of analog pixel matrix cells having N elements and the circuitry necessary to sense the linear transform result and compute RMS correction terms and drive the resulting signal onto an LCD column electrode.

Capacitor C4 is used to reduce the effects of switch induced charge injection by switch (65) shown in the simplified charge sense amplifier (67) of FIG. 5. The reset operation of the charge sense amplifier (67) of FIG. 5 can create transform computation errors due to switch induced charge injection. Switches typically contain both p-FETs and n-FETs whose gates are driven high or low to modulate the conductance between the source/drain connections. The action of turning 'off' a switch, which happens, for example, at the end of the reset cycle of the circuit of FIG. 5, involves driving the gate voltage of an n-FET from a high to low voltage and vice versa for a p-FET. The gate voltage is capacitively coupled into the switch terminals via the gate-to-drain capacitance of the switch FETs, which capacitance varies in proportion to the size of the switch FETs. This stray capacitive coupling induces a charge injection into the switch terminals.

Another charge injection effect is caused by the partition of channel charge in the FETs. Thus, a design tradeoff exists between using large switches needed for good conduction and the problem of unwanted charge induced error voltages. These effects are further described in P. E. Allen and D. R. Holberg, *CMOS Analog Circuit Design*, Holt, Rinehart and Winston, New York, 1987.

Referring to FIG. 6, switches S1 and S2 are both closed during the reset operation of the charge sense operational amplifier (71). Switch S1 should be much larger than S2, since S1 drives the large capacitance of the sensing line (32). Due to its size, switch S1 can inject significant charge into the sense line when it is opened. By opening S1 first, the output voltage, V1, is not affected by S1 charge injection, as S2 is still closed. When S2 opens, only a small charge injection offset will be created at the output.

The output of the charge sense amplifier, V1, is passed through at least one conventional offset compensated sample-and-hold circuit (77). Sample-and-hold circuits appropriate for use in the present invention are described in R. Gregorian and G. C. Temes, *Analog MOS integrated Circuits for Signal Processing*, John Wiley & Sons, New York, 1986, p. 416. Only one sample and hold circuit is shown for this function in FIG. 6, although more sample and hold circuits may be needed in practice, depending on system timing. Other conventional sample-and-hold circuits can be substituted, such as an offset compensated unity gain capacitive amplifier.

The sample-and-hold circuit (77) shown in FIG. 6 stores the previously computed transform result, while the next transform result is computed. The output of the sample-and-hold amplifier, V2, is connected to a high voltage amplifier (78) which is configured as a fixed-gain inverting amplifier with offset compensation. This three amplifier system can be completely offset compensated by clocking the appropriate switches in the particular order described below. Additionally, the zero point reference voltage of the output amplifier can be arbitrarily set without offsets using this system, as described below.

The offset compensation operation starts with the reset of the charge sense amplifier (70) by momentarily closing then opening switches S1, S2 and S6, in that order. Switch S5 is then closed to inject the zero point reference charge through C1 onto the sense line (32) which creates an output voltage, V1, from charge sense amplifier (70) equal to:

$$V_1 = V_{ref} + V_{os1} + \frac{C_1 V_{zero}}{C_2}, \tag{26}$$

wherein $V_{OS1}$ is the inherent offset voltage of the operational amplifier (71), $V_{ref}$ is a DC reference voltage and $V_{zero}$ is the adjustable voltage which sets the zero point voltage of the high voltage amplifier output, $V_{col}$. Capacitor $C_1$ is also used to inject charge during the computation of the DC transform term to compensate for the parasitic coupling capacitance that was discussed above. The output voltage from amplifier (70) is passed through the sample-and-hold amplifier (77) by proper clocking of switches S7–S9. Appropriate clocking schemes can be found in Gregorian and Temes, p. 416. An appropriate clocking scheme can be S expected to introduce no offsets, such that:

$$V_2 = V_{ref} + V_{os1} + \frac{C_1 V_{zero}}{C_2}, \tag{27}$$

wherein V2 is the output voltage of the sample and hold circuit (77). The sample-and-hold circuit (77) can be clocked to quickly sample the charge sense amplifier voltage, V1, allowing the voltage, V2, to be constant for most of the computation time. The sample-and-hold circuit allows V1 to change without affecting V2. V2 is used to drive the output voltage, $V_{col}$.

Switches S10, S12 and S13 are then closed (in this case the order is unimportant) to reset the output amplifier (73). The offset voltage of the high voltage amplifier (78) is stored on capacitors C7 and C8. Switches S13, S10 and S12 are then opened, in that order, after which switch S11 is closed, resulting in an output voltage, $V_{col}$, equal to $V_{low}$, with no offset. $V_{low}$ is the positive input to the high voltage operational amplifier (73) and is chosen to be a low voltage that is close to ground for reasons explained below. The exact clocking sequence of the switches can be modified in accordance with the well known principals of switched capacitor filters, as described in Gregorian and Temes, to achieve the same offset compensated result.

Once the offset computation operation is completed, the amplifier system is then ready for a computation cycle. The charge sense amplifier is reset using the method described before and the transform computation is performed by transferring charges beneath the sense line (32) in accordance with the binary basis vector, resulting in the following voltage at the output of the column charge sense amplifier:

$$V_1 = V_{ref} + V_{os1} - \sum_{i=0}^{N-1} \frac{Q(i)W(i,t)}{C_2}, \tag{28}$$

wherein Q(i) is the amount of charge effectively stored in the particular column of matrix cells and W(i,t) is the +/−1 basis vector that is multiplied with the analog pixel matrix. V1 is passed through the sample-and-hold circuit (77) as before, changing V2 from its previous value (i.e. Equation (20)) by the amount:

$$\Delta V_2 = -\frac{C_1 V_{zero}}{C_2} - \sum_{i=0}^{N-1} \frac{Q(i)W(i,t)}{C_2}. \tag{29}$$

These computation operations produce a column output voltage, $V_{col}$, which can be expressed as:

$$V_{col} = V_{low} + \frac{C_6}{C_9}\left[\frac{C_1 V_{zero}}{C_2} + \sum_{i=0}^{N-1} \frac{Q(i)W(i,t)}{C_2}\right]. \tag{30}$$

$V_{col}$ is free of offset errors and has an arbitrarily set zero reference output voltage. The zero reference point can be a voltage outside the power supply rails of the preceding amplifiers and can be much larger than either differential input voltage of the high voltage amplifier (73).

Other amplifier configurations are possible to implement the functions of the charge sense amplifier (70), sample-and-hold (77), and high voltage amplifier (78) circuits shown in FIG. 6 using, for example, the techniques and circuits discussed in Gregorian and Temes. Furthermore, the exact clocking sequence of the aforementioned switches can be modified while still retaining the desired offset compensated amplification within the guidelines described in Gregorian and Temes. These clocking modifications are considered to be within the scope of the present invention.

The apparatus described above uses a charge transfer technique to compute the linear transform of the pixel data. Those skilled in the art will recognize the advantages of low power, dense memory circuits, the ability to fabricate these circuits using low voltage 'commodity' CMOS techniques, high memory bandwidth, etc., that are fundamental aspects of manipulating charge packets under the gates of CMOS FETs. Numerous other loading and computational procedures are enabled by the present invention that permit manipulation of charges in the analog pixel matrix cells to arrive at various desirable computational results.

IV. High Voltage Output Amplifier

The video image transforms of the present invention can be amplified and driven onto the LCD electrodes using a variety of conventional LCD driver ICs. Applicant prefers the present high voltage amplifier circuit since it can be monolithically integrated onto the same substrate as the analog pixel matrix using a low voltage CMOS fabrication process.

The high voltage operational amplifier (73) shown in FIG. 6 is capable of driving the relatively large capacitive load of the column lines with fast rise/fall times. The amplifier uses parasitic devices present in conventional low voltage CMOS fabrication processes to attain high output voltages without exceeding the voltage specifications of the standard CMOS transistors. The output stage of the present invention can attain an output voltage range several times greater than the maximum specified voltage for the standard transistors of the fabrication process with which the amplifier is constructed.

Standard CMOS fabrication processes are not commonly used to construct amplifiers capable of driving large (>100pF) external loads at the high voltages (>10V) necessary for driving LCDs with either conventional row-at-a-time addressing or transform addressing. Typical CMOS FETs break down at <10V, due to zener action of the drain, punch-through in short channel devices and oxide insulator failure due to hot electron effects. J. Y. Chen, *CMOS Devices and Technology for VLSI*, Prentice Hall, Englewood Cliffs, N.J., 1990.

Many applications, including passive LCD driver circuits, require high drive voltages and present large capacitive loads to the output drivers. Previously, passive LCD driver ICs have required special high voltage CMOS fabrication processes that are more expensive than standard CMOS fabrication processes. This invention makes possible the implementation of efficient high voltage output amplifiers fabricated in conventional low voltage (i.e. less than 5V) CMOS processes. Using a standard fabrication process will reduce the cost of LCD driver chips significantly and allow the monolithic integration of more advanced electronics, available only with the standard processes, that are required to implement transform addressing.

Figure 10:
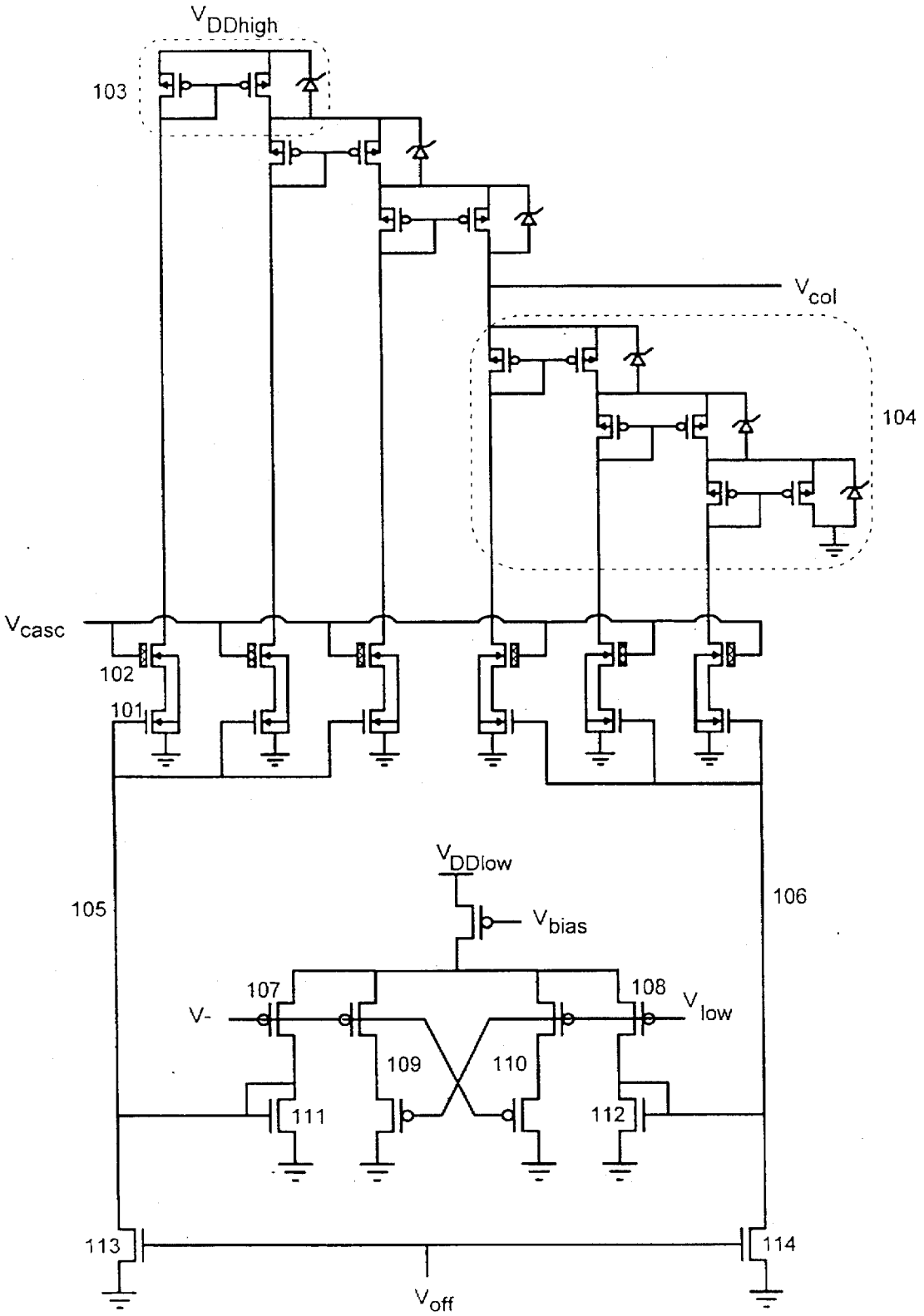
FIG. 10 is a detailed schematic of a high voltage operation amplifier that can be used with the circuits shown in FIGS. 6–9. The high voltage operational amplifier uses a series of cascaded p-FET current mirrors that are each fabricated in separate N-wells to achieve a wide output voltage range.

Applicant's preferred high voltage operational amplifier circuit is described herein and shown in FIG. 10. This high voltage amplifier circuit and other variations that are appropriate for use with the present invention are described in the copending application, Ser. No. 08/185,540.

Figure 7:
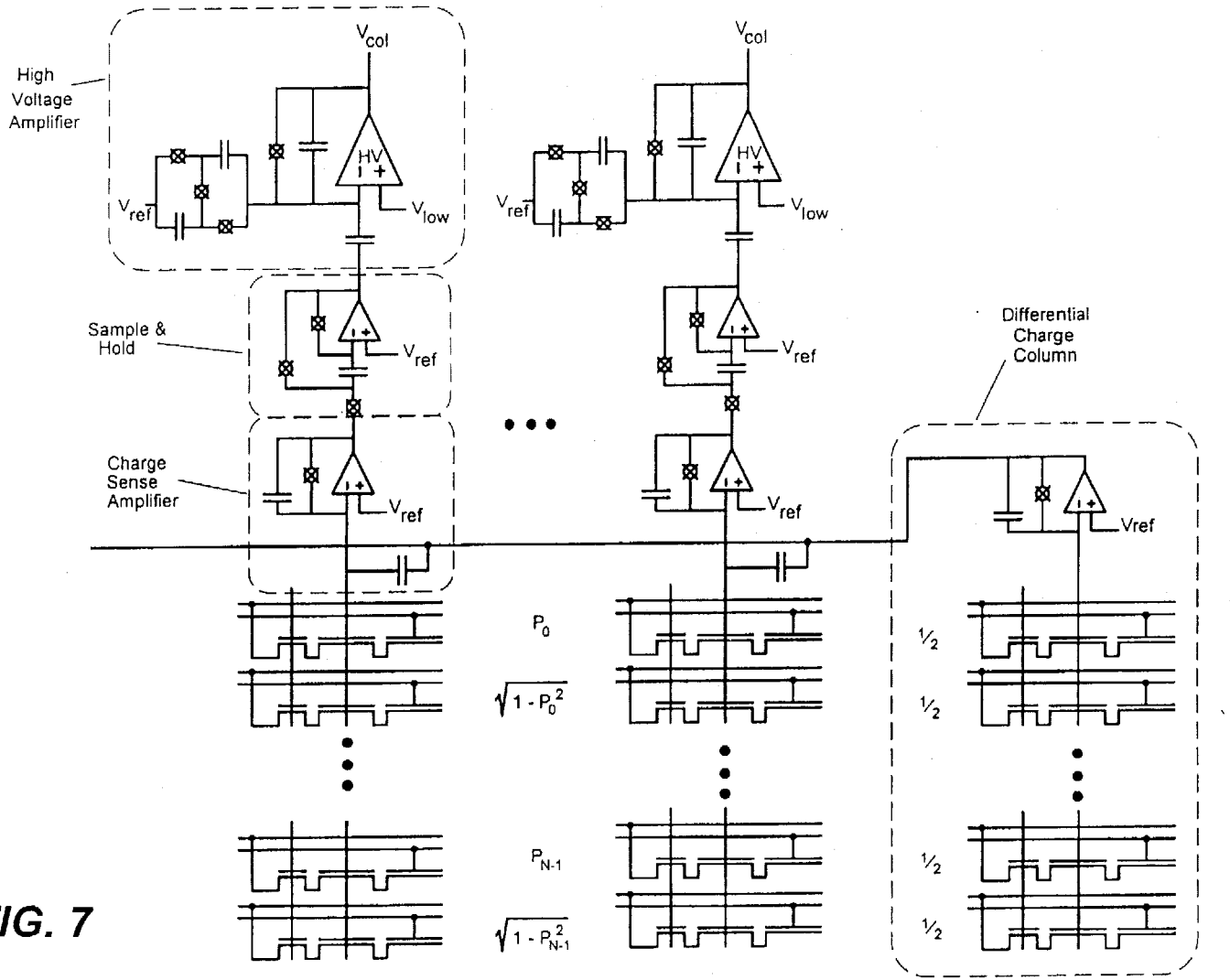
FIG. 7 is a detailed schematic of an alternate charge sensing, RMS compensation and high voltage output circuitry associated with two columns of the analog pixel matrix.
Figure 11:
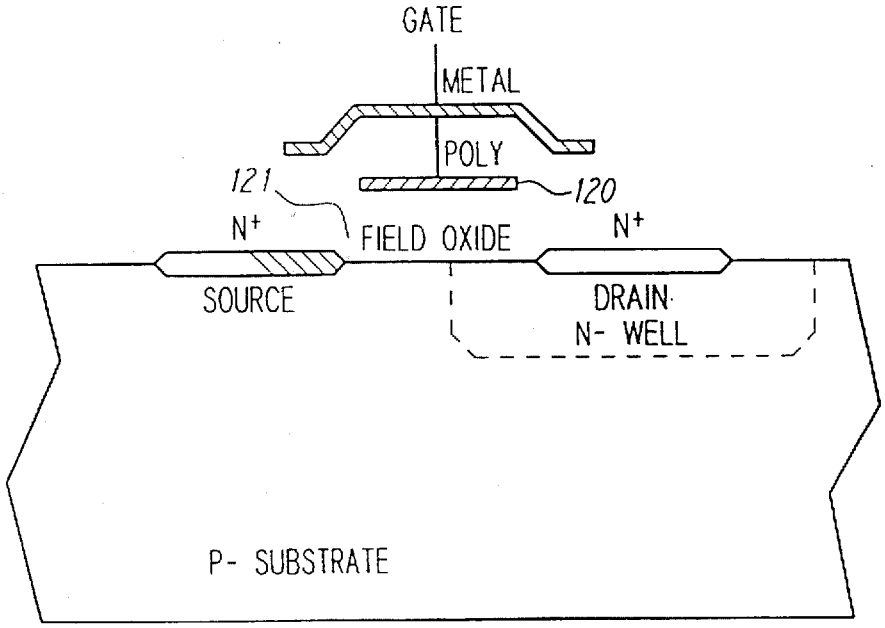
FIG. 11 is a physical cross section of the parasitic field oxide FET that can be used in the high voltage operational amplifier of FIG. 10 and also in the high voltage switch of FIG. 13.

One repeated element of the circuit shown in FIG. 7 is the two transistor high voltage current source or pull-down. The high voltage pull-down is a set of two n-channel FET transistors, the first (101) of which is a standard polysilicon gate device. The second transistor (102) is a parasitic field oxide transistor, a cross-section of which is shown in FIG. 11. Related devices using the thin gate oxide have been fabricated in CMOS processes. See, e.g., Z. Parpia, C. A. T. Salama and R. A. Hadaway, 'Modeling and Characterization of CMOS-Compatible High-Voltage Device Structures,' *IEEE Transactions on Electron Devices*, Vol. ED-34(11), pp. 2335–2343, 1987. Although transistor (102) has poor performance, it is being used herein as a cascode transistor. Examples of cascode transistors can be found in Allen and Holberg, p. 233. As a cascode transistor, the parasitic field oxide transistor (102) only passes the control current of the first n-FET (101). If the field oxide transistor (102) is kept in saturation (i.e. its gate voltage is set sufficiently high so that the saturation current of the field oxide FET (102) is greater than the current in n-FET (101)), the current in the pull-down is limited, and hence controlled, by the thin gate oxide transistor (101).

Parasitic well-to-bulk diodes in standard CMOS processes can typically sustain a reverse bias of over 40V, hence the drain of transistor (102) will not break down for voltages less than ~40V. Transistor breakdown by the punch-through effect, as described in Chen, can be avoided by increasing the length of the channel, typically to a few microns long. Referring to FIG. 11, the field oxide (121) acts as the effective gate oxide of the field oxide transistor and also can sustain a large voltage. By adding a polysilicon gate (120) beneath the middle portion of the field oxide FET, transistor performance is maximized, since the effective gate oxide thickness is reduced. The FET shown in FIG. 11 is a high voltage device with a very high threshold (typically over 15V) but since it is being used herein only as a cascode transistor, the high threshold is not detrimental to the performance of the high voltage amplifier.

Referring back to FIG. 10, the output pull-up section of the high voltage amplifier comprises a cascade of p-channel current mirrors (103). The top of the cascade is connected to a high voltage power source, $V_{DDhigh}$, which output power supply is used to drive the column lines of the LCD. Each current mirror in the cascade is fabricated in its own n-well. Each current mirror drops some of the high voltage across it, with the parasitic zener diodes providing protection against excessive drain-source voltage that can cause device failure.

Figure 12:
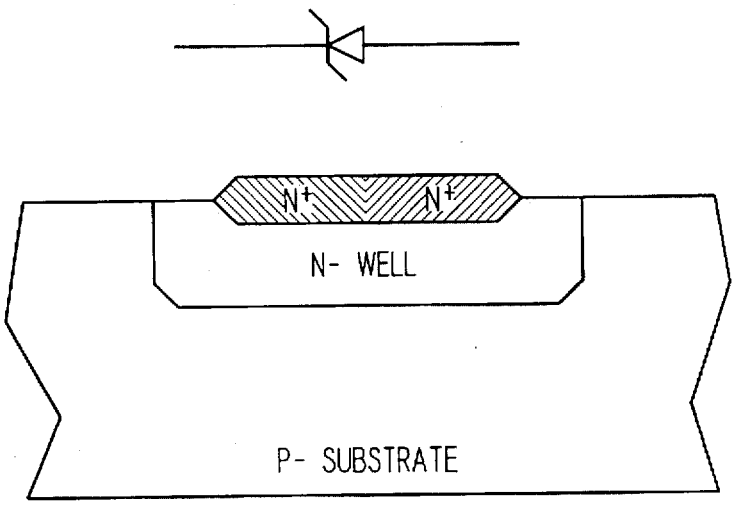
FIG. 12 is a physical cross section of a parasitic zener diode that can be used as overvoltage protection in the high voltage operation amplifier of FIG. 10.

The parasitic zener diodes of FIG. 10 are fabricated by placing an n+diffusion in contact with a p+ diffusion in an n-well, as shown in FIG. 12. Parasitic zener diodes fabricated in typical CMOS processes have a zener breakdown of between 3–5V and thus limit the maximum source-drain voltage drop of each of the cascaded current mirror stages.

By cascading many of these current mirror stages in FIG. 10, the full output voltage range can be covered. The current inputs into the current mirrors (103) are sourced by high voltage metal FET cascodes (102) and a set of conventional n-channel FETs (101) in series which form high voltage pull-downs. The output pull-down (104) is comprised of a set of similarly cascaded current mirrors that are biased by high voltage current sources.

The number of cascaded current mirror sections is variable and can be tailored to the particular semiconductor fabrication process and output voltage range desired. The zener diodes limit the total voltage that can be dropped across each current mirror stage in the cascade. A preferred number of stages is 3 or 4, although more or less may be appropriate in different circumstances. This output stage also is not restricted to n-well processes, as all the voltages can be reversed and all n and p sections swapped for a p-well process.

The high voltage output section has two lines for two control voltages, line (105) controlling the pull-up and line (106) controlling the pull-down. To reduce quiescent current draw from the high voltage supply, $V_{DDhigh}$, a current-shunting circuit can be utilized and an appropriate example is shown in FIG. 10. The preferred current-shunting circuit is comprised of a differential pair, i.e., FETs (107 and 108), with two additional current shunt paths. When the two input voltages on gates (107) and (108) are the same, the majority of the bias current flows through the middle branch FETs (109–110). An input voltage difference causes current flow through the n-channel FETs (111–112). The current flow arising from a voltage difference drives the output pull-up and pull-down circuits through lines (105) and (106). The degree of current turn-off when equal voltages are at the input terminals is determined by the ratio of transistor sizes of the middle branches (109–110) to the transistor sizes of the outer branches (107–108). An additional set of transistors (113–114) can be added to shunt current from the differential pair when the output, $V_{col}$, is not to be driven.

For square wave outputs, as are typical in LCD systems, the shunted current prevents quiescent bias current flow through the large output transistors (101–104), and can lead to significant power savings. This current-shunting circuit has advantages over the traditional actively biased amplifiers, described for example, in Allen and Holberg, in that it does not have instability problems and does not require well matched components.

Figure 13:
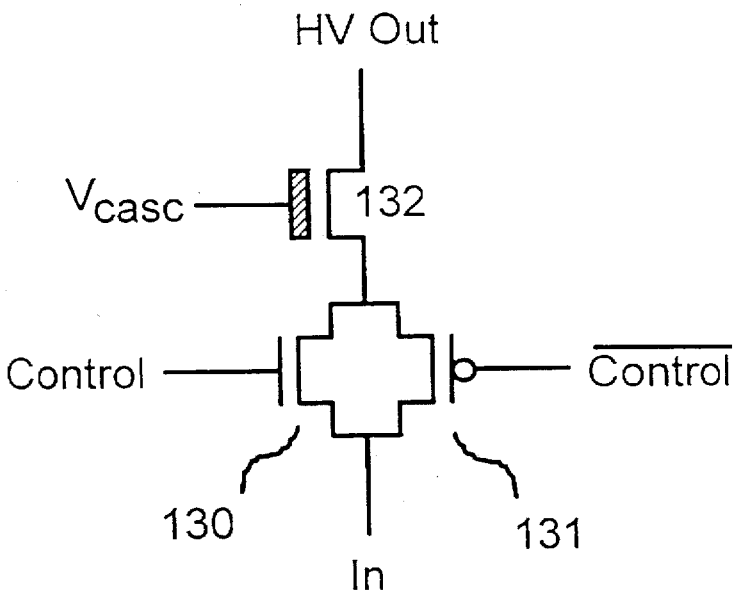
FIG. 13 is high voltage switch constructed from a high voltage field oxide FET and normal low voltage FETs. This special switch can be used for reset switch S13 of the high voltage amplifier of FIG. 6.

In the amplifier system of FIG. 6, switch S13 has one terminal that may exceed the voltage limits of FETs fabricated in low voltage CMOS processes. Therefore, a switch that can handle high (greater than 5V) voltages is required to implement this circuit. One example that is appropriate is shown in FIG. 13. The switch action is performed by a normal p-FET (131) and n-FET (130) switch pair. A high voltage FET (132) acts to buffer one end of the switch so that the terminal can be attached to high voltages. Note that the high voltage cascode transistor (132) cannot conduct unless its source voltage is at a low voltage, typically less than 1V. For this reason, the positive input to the high voltage amplifier is set at a low voltage, $V_{low}$. When amplifier (73) is being reset by closure of switch S13, the inverting input of the amplifier will be driven to approximately $V_{low}$, which should be set low enough to permit conduction in the high voltage cascode transistor. Note that the differential pair of the high voltage amplifier is comprised of p-FETs that can function properly at low input voltages.

V. RMS Compensation Circuitry

Continuing with FIG. 6, a RMS correction term can be computed as the transform results are generated. The RMS correction term is divided and evenly distributed among the transform signals within each frame refresh period. The number of RMS correction terms, $K_{max}$, and the number of transform results, N, specifies the number of transform computations between RMS correction terms. The system computes $N/K_{max}$ transform terms, then an RMS correction term and then a DC transform term. No specific order or number of terms is necessary to practice the invention. The RMS correction term in Equation (15) can be simplified by combining constants into the equation:

$$V^{(k)}_{RMSCorrect} = V_{const}\left[B_1 + \sqrt{B_2 - \sum_{t=k(N/K_{max})}^{(k+1)(N/K_{max})} T^2(t)}\right], \quad (31)$$

wherein $B_1$ and $B_2$ are constants. The partial sum of the squared transform results is computed, subtracted from a constant ($B_2$), the square root is taken and the resulting voltage is applied to the column electrodes with a constant offset ($B_1$).

The square of the transform results are computed and summed in circuitry block (22) of FIG. 2 in order to compute the RMS correction term. A number of different conventional methods can be used to implement this circuitry block, some of which are described in Allen and Holberg, p. 631, and also in C. A. Mead, *Analog VLSI and Neural Systems*, Addison-Wesley, Reading, Ma., 1989, p. 238. Conventional analog "square and integrate" circuits can be used for this function. Conventional analog-to-digital conversion (ADC) can be performed on the analog transform outputs, the results squared and then summed in a digital fashion. Because of the relatively slow sample rate of the analog information in the present invention, multiplexed digital circuitry can be used to perform the square and sum. This multiplexing saves chip area, thereby reducing manufacturing costs.

Figure 14:
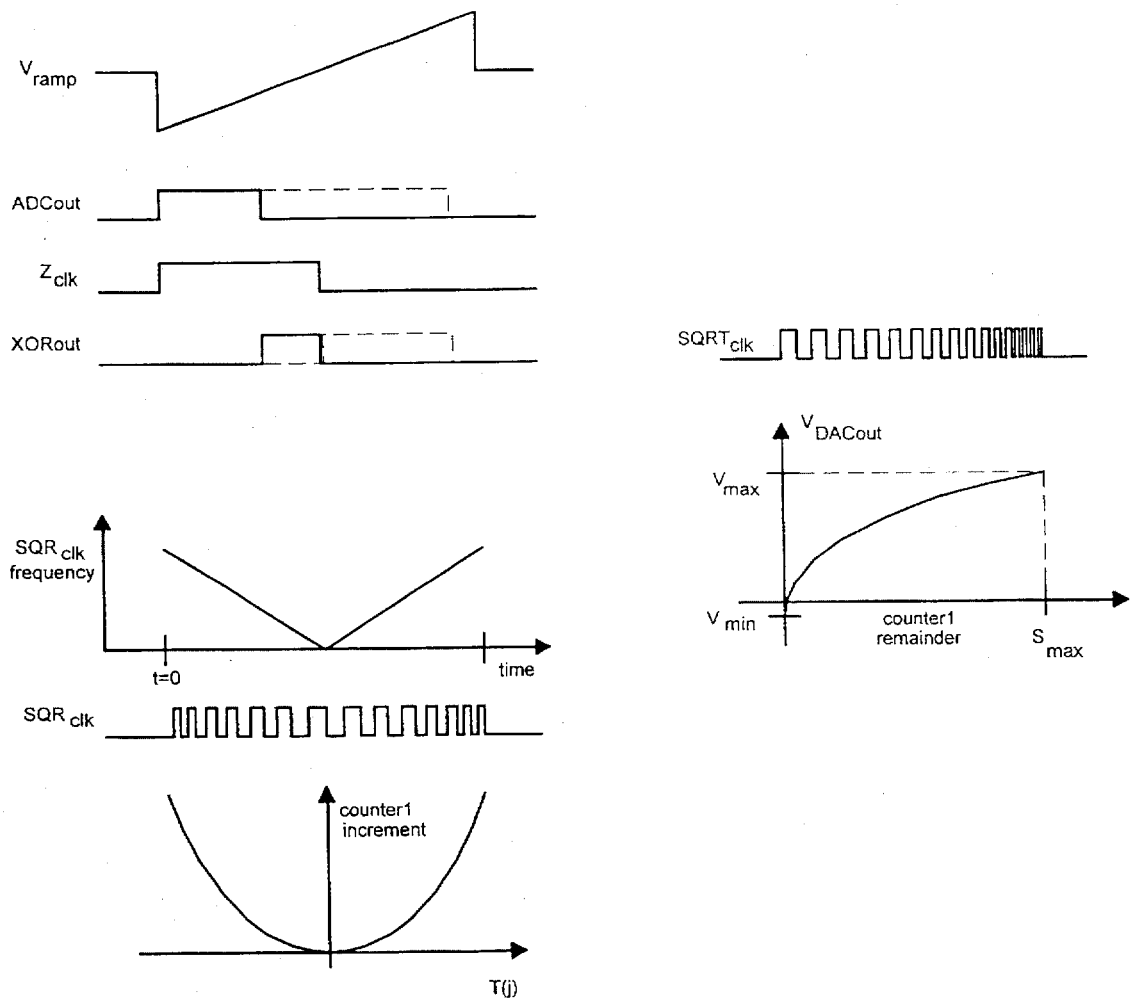
FIG. 14 shows a series of ramp, clock and output waveforms used to describe the operation of the circuit in FIG. 6.

A hybrid digital/analog system is shown in FIG. 6. The voltages and waveforms of two examples are shown in FIG. 14 along with the relevant reference signals. The analog transform output of the charge sense amplifier (70) is sampled by a sample-and-hold circuit (79) and converted into a digital pulse width by comparator (75). A reference ramp signal, $V_{ramp}$, and the transform signal are summed on the negative input of comparator (75) which acts as a conventional serial ADC (80). The comparator output is a digital pulse in which the analog transform value is encoded as the position in time of the transition point. The output of two signals is shown in FIG. 14 as ADCout. This output pulse enters an exclusive-or (XOR) logic gate (81) that has, as its other input, a reference timing signal, $Z_{clk}$. $Z_{clk}$ transitions when a transform result of zero would cause the ADC output to transition. The XOR logic gate (81) serves to convert the signal from serial ADC (80) into a pulse on either side of the $Z_{clk}$ transition. As shown in FIG. 14, XORout has a width proportional to the magnitude of the transform result about the zero point.

This pulse width serves to gate (through AND gate (82)) a frequency modulated signal, $SQR_{clk}$, which signal enters an up-counter, counter1 (83). Conventional CMOS counter circuits can be used to practice the present invention and appropriate examples are described in N. H. Weste and K. Eshraghian, *Principles of CMOS VLSI Design*, Addison-Wesley, Reading, Ma., 1993, p. 539. The clock signal, $SQR_{clk}$, has a frequency proportional to the relative time to the zero point transition, as shown in FIG. 14. Counter1 (83) integrates a portion of the frequency modulated clock signal, depending upon the magnitude of the transform pulse width. The incremental change of counter1 is proportional to the square of the transform magnitude. Thus the total count over many transform computations is representative of a sum of squares of the transform results, as required.

The accuracy of this square circuit depends upon the range of clock frequencies over which counter1 (83) can reliably operate. The ADC clock frequency is typically 2 to 4 MHz, while counters in the preferred single polysilicon fabrication technology can reliably operate above 20 MHz. Thus, roughly 4 to 8 clock multiples of frequency range can be used in generating $SQR_{clk}$, providing adequate accuracy for the desired computation.

The constant $B_2$ from Equation (31) is simply the maximum count of counter1 (83). $B_2$ minus the sum of the $N/K_{max}$ squared transform results is the remaining count left in counter1 (83). To compute the square-root of this difference, a square-root clock, $SQRT_{clk}$, is used to count the remainder left in counter1 (83). An appropriate clocking scheme is shown in FIG. 14. When counter1 (83) reaches its maximum, a carry signal on line (85) is generated. The carry signal on line (85) activates switches S19–S21 which act to 'sample' the linear ramp; $V_{ramp}$. Amplifier (76) acts as a serial DAC (86), converting the timing of the switch pulses into an analog voltage.

The logic block (84) in FIG. 6 generates the proper pulse signals to drive the DAC switches S19–S21 based upon the carry signal (85). The DAC (86) output voltage, i.e. the RMS correction voltage, is applied to the sample-and-hold (77) input using switches S22–S23. By switching from $V_{ref}$ (i.e. S23 closed, S22 open) to the DAC (86) output voltage (i.e. S22 closed, S23 open) the RMS correction term, referenced to $V_{ref}$, is loaded into the sample and hold circuit 77). This operation causes the high voltage output amplifier (78) to drive the column electrodes of the display with the proper RMS correction terms.

The minimum voltage output of DAC (86), $V_{min}$, is set to be the voltage that will drive the column output voltage to be equal to the voltage on the row electrodes. In this situation, the voltage across all the LCD pixels in the particular display column is zero, i.e. a zero RMS correction.

In the case where counter1 (83) exceeds its maximum count and generates a carry signal prior to the end of the RMS correction accumulation period, an additional counter, counter2 (87), is incremented. If counter2 (87) is non-zero, the next RMS correction term is set to $V_{min}$ through the timing of the DAC switch pulses. This determination is made by logic block (84). In this case, counter2 (87) is decremented and counter1 (83) is not clocked by $SQRT_{clk}$. Thus, counter1 (83) retains the remainder of the RMS correction term and DAC (86) generates a minimum correction term. Only when counter2 (87) has been decremented down to zero can the DAC (86) output be anything other than $V_{min}$. Thus, this system is capable of implementing the remainder carry-over method discussed above and can maximize the selection ratio of the addressing method.

The reference timing signals and ADC/DAC ramp signal are global signals that are common to all output circuits. These signals can be generated on the column driver IC or on a separate IC that provides signals to all column driver ICs.

An alternate LCD driving compensation system that provides for RMS compensation is shown in FIG. 7. In this system, the analog pixel matrix has twice the number of elements as the matrix described in FIG. 6 and is capable of storing two charge packets for each pixel. Referring to FIG. 7, the circuitry for processing and driving video signals onto two LCD column electrodes is shown. Also shown is an additional array of analog pixel cells which is labelled as a differential charge column. This differential charge column is loaded with a set of charges that are equal for each cell in the column and generates a differential signal that is subtracted from the column charge sense amplifiers by capacitive coupling.

One of the charge packets stored in the analog pixel matrix is proportional to the pixel value, P(i). The other stored charge packet is proportional to $\sqrt{1-P^2(i)}$. Each pixel storage location consists of two analog pixel matrix cells. Two binary basis vector electrodes are used per pixel location to alternately add or subtract the two stored charges, P(i) and $\sqrt{1-P^2(i)}$ from the column sense electrode. This system can be used to implement the algorithms described in equations (18) through (24) above.

The P(i) term is loaded into the analog pixel matrix in the same fashion as has been described herein. Referring to FIG. 7, the P(i) term is loaded into one of the two storage cells per pixel. The $\sqrt{1-P^2(i)}$ term can be calculated by using a conventional digital look up table or a conventional analog voltage-to-voltage converter. Once the $\sqrt{1-P^2(i)}$ term is calculated, it is loaded into the second storage cell for the pixel as has been described above.

The transform computation and output signal driving steps are accomplished in two phases. In the first phase, the binary transform of $p(i)+\sqrt{1-P^2(i)}$ is computed and driven onto the LCD column electrodes. This operation is accomplished by pulsing the two binary basis vector electrodes connected to the two analog pixel cells at each pixel storage location in the same direction during the computation phase. In the second phase, the transform of the difference of the two charges stored at the pixel storage locations, which is proportional to $p(i)-\sqrt{1-P^2(i)}$, is computed and driven onto the LCD electrodes. This operation is accomplished by pulsing the two binary basis vector electrodes connected to the two analog pixel cells at each pixel storage location in the opposite direction during the computation phase of the analog pixel matrix.

Figure 15:
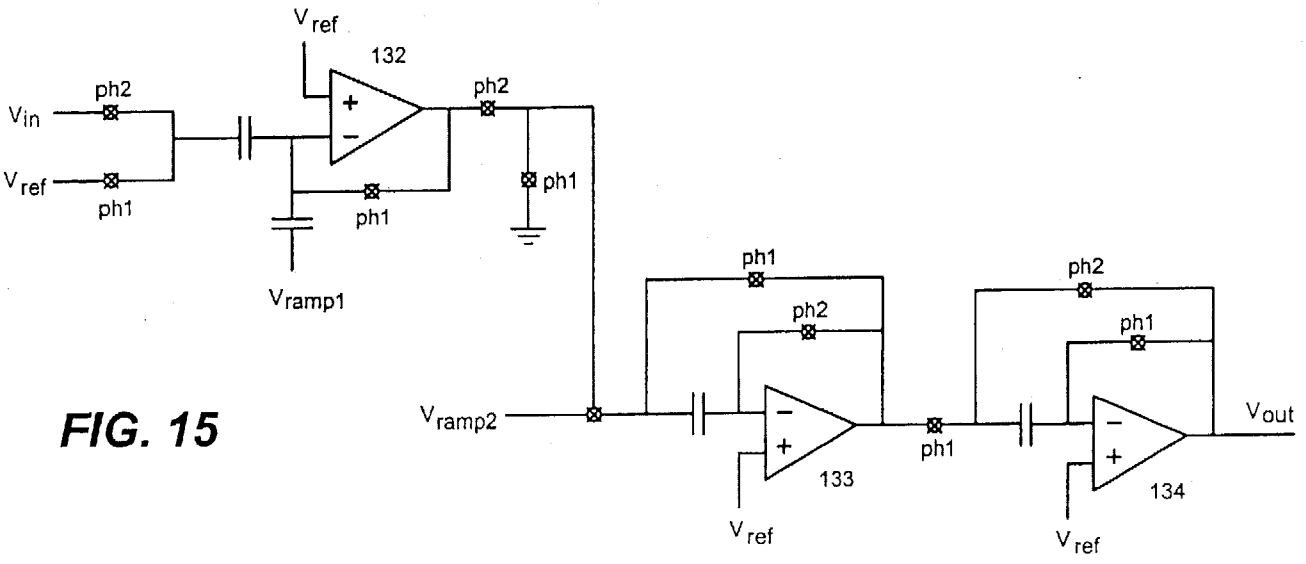
FIG. 15 is a schematic of a voltage to voltage converter that is appropriate for use with the circuit shown in FIG. 7.
Figure 16:
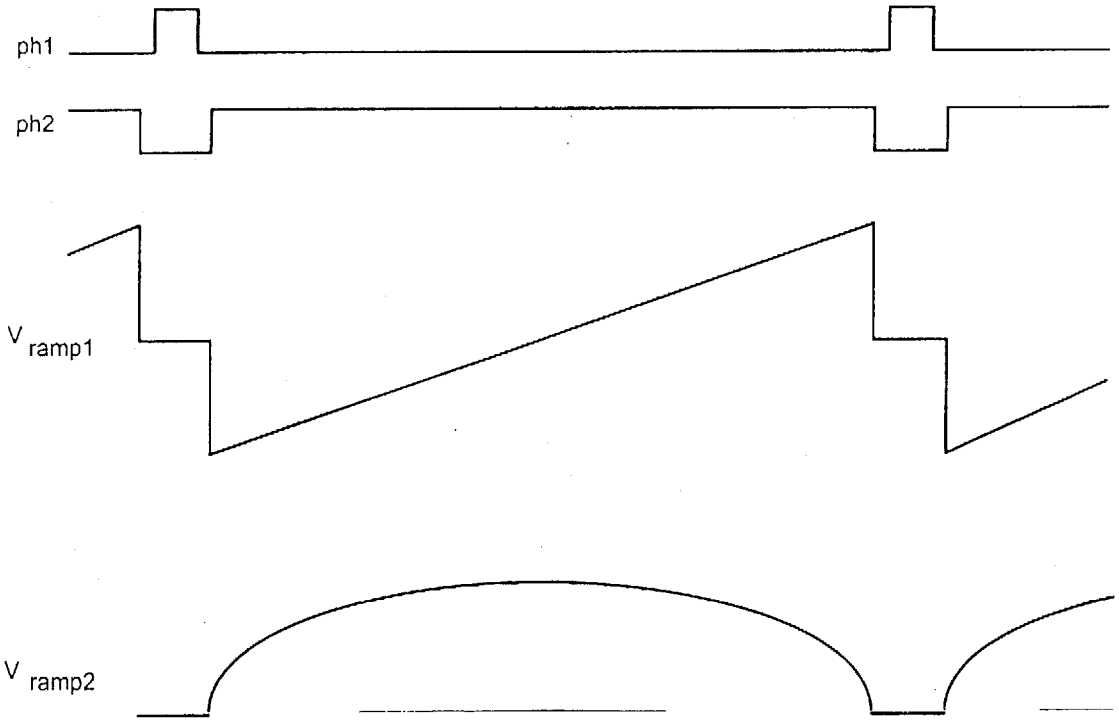
FIG. 16 shows two blanking signals and two ramp signals that are appropriate for use with the voltage-to-voltage converter shown in FIG. 15.

An example of a voltage-to-voltage converter to generate the $\sqrt{1-P^2(i)}$ term that is appropriate for use with the circuit shown in FIG. 7 is shown in FIG. 15. A first ramp signal can be generated by a conventional switched capacitor integrator. An appropriate example of a switched capacitor integrator is described in Gregorian and Temes, p. 278. This ramp signal is shown as $V_{RAMP1}$ in FIG. 16 and is capacitively coupled to the negative input of comparator (132) along with the output of the video sample and hold circuit. This video sample and hold circuit has been video input signal, P(i), from a serial stream of video information. The comparator (132) generates a binary output signal that transitions at a time period determined by the video input signal voltage. The transitioning output is used as a digital sample signal which samples a second ramp signal, $V_{RAMP2}$, and stores the sampled voltage in a first sample and hold circuit (133). $V_{RAMP2}$ is also shown in FIG. 16. A second sample-and-hold circuit (134) can be used to output the converted video pixel voltage. By choosing the ramp signals properly, any arbitrary mapping can occur between the input and output voltages. In this example, using the ramp signals shown in FIG. 16, the input voltages are proportional to P2(i) and the output voltages of the circuit shown in FIG. 12 are proportional to $\sqrt{1-P^2(i)}$.

The examples and figures described herein are intended to be illustrations of the present invention and should not be interpreted as limitations. Those individuals with ordinary skill in the art will recognize that numerous changes can be made to the described embodiment without departing from the spirit of the present invention.

I claim:

1. An apparatus for addressing a liquid crystal display with video pixel information, comprising:

(a) analog memory for storing a first and a second value, wherein the first value is representative of the video pixel information and the second value is representative of a square root of a constant minus a square of the video pixel information;

(b) analog computation means for computing a linear transform of the first and second values; and (c) at least one amplifier for driving at least one column electrode of the liquid crystal display with a first voltage representative of the linear transform of the first value minus the linear transform of the second value and a second voltage representative of the linear transform of the first value plus the linear transform of the second value.

2. An apparatus as in claim 1 further comprising means for generating a differential signal, wherein the differential signal is subtracted from the voltages driven onto the column electrode of the liquid crystal display.

3. An apparatus as in claim 1, wherein the linear transforms are computed with a basis vector and wherein the basis vector is selected from the group consisting of a binary basis vector and a ternary basis vector.

4. A method for addressing a liquid crystal display having multiple overlapping row and column electrodes affixed to substrates on opposite sides of liquid crystal material wherein the overlapping row and column electrodes define a matrix of pixels that display gray-scale video information, the method comprising the steps of:

(a) storing the gray-scale video information as a matrix of analog electric charges in an analog vector-matrix multiplier;

(b) multiplying the matrix of stored video information by a basis vector in the analog vector-matrix multiplier, wherein the basis vector is selected from a group consisting of a binary and a ternary basis vector, whereby a video information transform vector is generated;

(c) addressing the column electrodes with a first set of voltages that is representative of the video information transform vector; and (d) simultaneously addressing the row electrodes with a second set of voltages that is representative of the basis vector, wherein at least two row electrodes are addressed with non-zero voltages.

5. A method as described in claim 4 further comprising the steps of:

(a) computing at least one RMS correction term; and (b) addressing at least one column electrode with a voltage that is representative of the RMS correction term.

6. A method as described in claim 5 wherein computing at least one RMS correction term comprises the steps of:

(a) squaring each element of the video information transform vector;

(b) summing the squares of at least two video image transform vectors, wherein the squares of the video information element for each respective column are summed;

(c) subtracting the sum of the squares of the respective elements of the video information vector from a constant; and (d) calculating a square root of the constant minus the sum of the squares of the respective elements of the video information transform vector.

7. A method as described in claim 5 wherein at least one RMS correction term is computed according to the equation:

$$\sqrt{C-\Sigma T^2}$$

wherein C is a constant and T is an element from the video information transform vector.

8. A method as described in claim 5 wherein the RMS correction term is divided into at least two partial correction terms and at least one column electrode is addressed with voltages representative of the partial correction terms.

9. An apparatus for addressing a liquid crystal display, wherein the liquid crystal display has multiple overlapping row and column electrodes affixed to substrates on opposite sides of liquid crystal material and wherein the overlapping row and column electrodes define a matrix of pixels that display gray-scale video information, comprising:

an analog vector-matrix multiplier, wherein the gray-scale video information is stored as a matrix of analog electric charges within the analog vector-matrix multiplier, and wherein the analog vector-matrix multiplier computes a video information transform vector by multiplying the matrix of analog electric charge with a basis vector, wherein the basis vector is selected from the group consisting of a binary and a ternary basis vector; and wherein the video information transform vector is applied to the column electrodes and the basis vector simultaneously is applied the row electrodes and wherein at least two elements of the basis vector are non-zero.

10. An apparatus as described in claim 9 wherein the analog vector-matrix multiplier includes a matrix of analog charge storage circuits, wherein the gray-scale video information is stored as packets of charge in the matrix of analog charge storage circuits.

11. An apparatus as described in claim 10 wherein each analog charge storage circuit is a field effect transistor having a gate and a substrate, wherein the gray-scale video information is stored as a packet of electric charge in the substrate underneath the gate of the field effect transistor.

12. An apparatus as described in claim 9 wherein the analog vector multiplier comprises:

(a) a matrix of analog memory/computation cells, wherein each analog memory/computation cell comprises a first, second and third field effect transistor (FET), wherein each FET has a gate, a source and a drain, wherein the drain of the first FET is connected to the source of the second FET and wherein the source of the third FET is connected to a terminal selected from the group consisting of the first FET drain, the second FET source and the second FET drain;

(b) a plurality of first electrodes, wherein each first electrode is connected to a plurality of the gates of the second FETs; and (c) a plurality of second electrodes, wherein each second electrode is connected to a plurality of the gates of the third FETs.

13. An apparatus as described in claim 12 further comprising a plurality of third electrodes, wherein each third electrode is connected to a plurality of the sources of the first FETs.

14. An apparatus as described in claim 12 further comprising a plurality of amplifiers, wherein the amplifiers are connected to the second electrodes.

15. An apparatus as described in claim 12 further comprising a basis function generator, wherein the basis function generator is connected to the plurality of third electrodes.

16. An apparatus as described in claim 9 further comprising an RMS correction term generator, wherein the RMS correction term generator comprises means for generating a signal determined by the equation:

$$\sqrt{C-\Sigma T^2}$$

wherein C is a constant and T is an element of the video information transform vector.

17. An apparatus as described in claim 9 further comprising means for dividing each RMS correction term into at least two partial correction terms and means for addressing the column electrodes with the partial correction terms.

18. An apparatus as described in claim 9 further comprising an RMS correction term generator, wherein the RMS correction term generator comprises:

(a) means for squaring each element of the video information transform vector;

(b) means for summing the squares of each element of the video information transform vector;

(c) means for subtracting the sum of the squares of each element of the video information transform vector from a constant;

(d) means for calculating a square root of the constant minus the sum of the squares of each element of the video information transform vector.

19. An apparatus as described in claim 9 further comprising a plurality of high voltage output amplifiers, wherein the high voltage output amplifiers amplify the video information transform vector prior to application to the column electrodes and wherein the high voltage output amplifiers are monolithically integrated with the analog vector-matrix multiplier.

* * * * *